US009454106B2

(12) United States Patent
Sekiguchi et al.

(10) Patent No.: US 9,454,106 B2
(45) Date of Patent: Sep. 27, 2016

(54) IMAGE FORMING APPARATUS WITH DRIVE CONTROL OF A DRIVEN MEMBER BASED ON A BETWEEN-SHEETS TIME

(71) Applicants: Sho Sekiguchi, Tokyo (JP); Takeshi Kojima, Kanagawa (JP); Tomoya Ohmura, Kanagawa (JP); Hiroomi Tamura, Kanagawa (JP); Tetsuto Ueda, Kanagawa (JP); Kazuya Saitoh, Kanagawa (JP); Taichi Urayama, Kanagawa (JP); Takuya Moriyama, Kanagawa (JP); Naoyuki Ozaki, Kanagawa (JP)

(72) Inventors: Sho Sekiguchi, Tokyo (JP); Takeshi Kojima, Kanagawa (JP); Tomoya Ohmura, Kanagawa (JP); Hiroomi Tamura, Kanagawa (JP); Tetsuto Ueda, Kanagawa (JP); Kazuya Saitoh, Kanagawa (JP); Taichi Urayama, Kanagawa (JP); Takuya Moriyama, Kanagawa (JP); Naoyuki Ozaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/811,119

(22) Filed: Jul. 28, 2015

(65) Prior Publication Data

US 2016/0041509 A1 Feb. 11, 2016

(30) Foreign Application Priority Data

Aug. 6, 2014 (JP) ..... 2014-160107
Nov. 17, 2014 (JP) ..... 2014-232597

(51) Int. Cl.
*G03G 15/16* (2006.01)

(52) U.S. Cl.
CPC ..... *G03G 15/161* (2013.01); *G03G 15/166* (2013.01); *G03G 15/168* (2013.01); *G03G 15/1675* (2013.01); *G03G 2215/1661* (2013.01)

(58) Field of Classification Search
CPC ..... G03G 15/1645; G03G 15/15168; G03G 15/161; G03G 15/166; G03G 15/1675; G03G 2215/1647; G03G 2215/1652; G03G 2215/1657; G03G 2215/1661
USPC ..... 399/66, 101
See application file for complete search history.

(56) References Cited

U.S. PATENT DOCUMENTS 5,179,397 A * 1/1993 Ohzeki ..... G03G 15/1675 347/140
5,729,788 A * 3/1998 Hirohashi ..... G03G 15/167 399/101

(Continued)

FOREIGN PATENT DOCUMENTS

JP 08211760 A * 8/1996
JP 2003-140477 5/2003

(Continued)

OTHER PUBLICATIONS

U.S. Appl. No. 14/718,567, filed May 21, 2015.

(Continued)

*Primary Examiner* — Robert Beatty
(74) *Attorney, Agent, or Firm* — Oblon, McClelland, Maier & Neustadt, L.L.P.

(57) ABSTRACT

An image forming apparatus is provided in which, during a continuous sheet passing, in the case where a between-sheets time is short, none of a cleaning mode and a drive OFF mode is performed; in the case where the between-sheets time is of a medium length of time, the cleaning mode is performed but the drive OFF mode is not performed; and in the case where the between-sheets time is long, both the cleaning mode and the drive OFF mode are performed. As a result, degradation of an image bearer due to the cleaning bias is alleviated, decreased productivity due to the cleaning mode is alleviated, a problem is alleviated in which a back surface of a recording medium gets dirty due to toner adhered to a transfer rotation body, and another problem is alleviated in which the service life of a driven member is shortened.

22 Claims, 21 Drawing Sheets

(56) References Cited

U.S. PATENT DOCUMENTS

| | | | | |
|---|---|---|---|---|
| 5,884,121 | A * | 3/1999 | Kyung | G03G 15/1675 399/313 |
| 2002/0061203 | A1* | 5/2002 | Akaike | G03G 15/168 399/75 |
| 2010/0196026 | A1* | 8/2010 | Shida | G03G 15/161 399/44 |
| 2014/0010568 | A1* | 1/2014 | Takayama | G03G 21/10 399/101 |
| 2014/0126942 | A1 | 5/2014 | Kojima et al. | |
| 2015/0110510 | A1* | 4/2015 | Ishikawa | G03G 15/1605 399/66 |
| 2015/0346652 | A1* | 12/2015 | Ohmura | G03G 15/1675 399/66 |

FOREIGN PATENT DOCUMENTS

| | | | |
|---|---|---|---|
| JP | 2003241613 | A * | 8/2003 |
| JP | 2012-042641 | | 3/2012 |
| JP | 2012-063497 | | 3/2012 |
| JP | 2012108405 | A * | 6/2012 |

OTHER PUBLICATIONS

U.S. Appl. No. 14/742,596, filed Jun. 17, 2015.

* cited by examiner

FIG.8

| PROCESS LINE SPEED | FIRST CLEANING BIAS (−) ADJUSTMENT FACTOR | SECOND CLEANING BIAS (+) ADJUSTMENT FACTOR |
|---|---|---|
| 75mm/s | 67 | 59 |
| 150mm/s | 83 | 77 |
| 260mm/s | 100 | 100 |

FIG.9

| ABSOLUTE HUMIDITY | FIRST CLEANING BIAS (−) | SECOND CLEANING BIAS (+) |
|---|---|---|
| $D \leqq 4.0$ | −4 μA | 10 μA |
| $4.0 < D \leqq 8.0$ | −5 μA | 12 μA |
| $8.0 < D \leqq 16.0$ | −6 μA | 14 μA |
| $16.0 < D$ | −8 μA | 16 μA |

IMAGE FORMING APPARATUS WITH DRIVE CONTROL OF A DRIVEN MEMBER BASED ON A BETWEEN-SHEETS TIME

BACKGROUND OF THE INVENTION

1. Field of the Invention

The present invention relates to an image forming apparatus of an electrophotographic system such as a copier, a printer, a facsimile machine, or a multifunction peripheral with two or more of copying, printing, and facsimile functions; in particular, relates to an image forming apparatus in which a transfer rotation body, which transfers a toner image borne by an image bearer such as a photoconductor drum or an intermediate transfer belt onto a recording medium, is arranged to abut the image bearer.

2. Description of the Related Art

Conventionally, in a technical field of an image forming apparatus such as a copier or a printer, in order to prevent a back surface or an edge surface of a recording medium which has been conveyed to a transfer nip unit from getting dirty due to toner which has moved from the image bearer and adhered to the transfer rotation body (transfer roller) at the transfer nip unit where the image bearer is pressed against the transfer rotation body, a technique is known in which a cleaning bias different from a transfer bias is applied to the transfer rotation body during time between sheets (between-sheets time)(refer to, for example, Patent Documents 1-3).

Here, during the between-sheets time, along with an image forming operation performed before and after the between-sheets time, a driving operation is continuously performed in which a driven member such as the image bearer is driven by a drive unit (drive motor).

On the other hand, Patent Document 1 discloses a technique in which, necessary time for cleaning (cleaning time) is calculated according to a size or a number of sheets of a recording medium which continuously passes through the transfer nip unit, the between-sheets time is increased or decreased according to the calculated cleaning time, and the cleaning mode of the predetermined time (cleaning of transfer rotation body) is performed.

Also, Patent Document 2 discloses a technique in which it is determined whether a cleaning mode should be performed according to the length of the between-sheets time which varies with various conditions during the continuous sheet passing, and, in the case where the between-sheets time has a certain length, the cleaning mode is performed from right after the beginning of the between-sheets time to a little before the end of the between-sheets time.

In the above technique disclosed in Patent Document 1, since the between-sheets time varies with cleaning time calculated according to predetermined conditions, there is a problem in which the between-sheets time may become too long and productivity during the continuous sheet passing may decrease.

Also, in the above technique disclosed in Patent Document 2, in the case where it is determined that the cleaning mode should be performed during the between-sheets time, since most of the between-sheets time is consumed by the cleaning mode, there is a problem in which degradation of the image bearer may be accelerated by direct contact with the transfer rotation body to which the cleaning bias is applied. Especially, in the case where the continuous sheet passing is frequently performed under a condition in which the between-sheets time is set long, the above problem becomes significant.

Also, in both techniques described above, since a driven member such as an image bearer is continuously driven by a drive unit, together with the image forming operation performed before and after the between-sheets time, during the between-sheets time in the continuous sheet passing, in the case where between-sheets time frequently becomes long, time driving the driven member becomes wastefully long and service life of the driven member or a related member may be shortened.

In order to solve the above problem, the present invention provides an image forming apparatus in which the degradation of the image bearer is not accelerated by a cleaning bias; productivity in the continuous sheet passing is not decreased by performing the cleaning mode; a problem, in which a back surface or an edge surface of a recording medium conveyed to the transfer nip unit may get dirty due to the toner moved from the image bearer and adhering to the transfer rotation body, is alleviated; and even in the case where between-sheets time frequently becomes long, the service life of the driven member may not be easily shortened.

[Patent Document 1] Japanese Laid-Open Patent Application No. 2012-42641

[Patent Document 2] Japanese Laid-Open Patent Application No. 2003-140477

[Patent Document 3] Japanese Laid-Open Patent Application No. 2012-63497

SUMMARY OF THE INVENTION

An image forming apparatus according to claim 1 of the present invention includes an image bearer configured to be driven to move in a predetermined direction and bear a toner image, a transfer rotation body configured to rotate in a predetermined direction, and abut the image bearer to form a transfer nip unit, a bias applying unit configured to apply a transfer bias to the transfer rotation body and/or a transfer counter-rotation body abutting the transfer rotation body via the image bearer so that the toner image is transferred onto a recording medium conveyed to the transfer nip unit, and a driven member configured to be driven by a drive unit during an image forming operation. The bias applying unit is configured to apply a cleaning bias for removing toner adhering to the transfer rotation body and a non-image area bias whose absolute value is less than the cleaning bias to the transfer rotation body and/or the transfer counter-rotation body. Time X, which is defined as between-sheets time from when the recording medium is fed out at the transfer nip unit to when the next recording medium is fed into the transfer nip unit while the image bearer is in a driven state and a plurality of the recording media are continuously conveyed, varies based on a predetermined condition. In the case where the time X does not exceed a threshold value X, the bias applying unit is controlled to apply the non-image area bias during all of the time X and the drive unit is controlled to drive the driven member during all of the time X. In the case where the time X exceeds the threshold value A and does not exceed a threshold value B which is greater than the threshold value A, the bias applying unit is controlled to apply the non-image area bias during time Z within the time X and apply the cleaning bias during time (X−Z), and the drive unit is controlled to drive the driven member during all of the time X. And in the case where the time X exceeds the threshold value B, the bias applying unit is controlled to, during the time Z within the time X, turn OFF bias application so that none of the transfer bias, the cleaning bias, and the non-image area bias is applied, or to apply the non-image area bias, which is equivalent to the bias application being turned OFF, and, during the time (X–Z), apply the cleaning bias. The drive unit is controlled to stop driving the driven member during time W within the time X and drive the driven member during time (X–W).

According to the present invention, an image forming apparatus can be provided in which the degradation of the image bearer is not accelerated by a cleaning bias; productivity in the continuous sheet passing is not decreased by performing the cleaning mode; a problem, in which a back surface or an edge surface of a recording medium conveyed to the transfer nip unit gets dirty due to the toner moved from the image bearer and adhering to the transfer rotation body, is alleviated; and even in the case where the between-sheets time frequently becomes long, the service life of a driven member may not be easily shortened.

Other objects, features and advantages of the present invention will become more apparent from the following detailed description when read in conjunction with the accompanying drawings.

BRIEF DESCRIPTION OF THE DRAWINGS

FIG. 8 is a table illustrating an adjustment factor of a cleaning bias which varies in accordance with a process line speed (conveyance speed).

FIG. 9 is a table illustrating a cleaning bias which varies in accordance with absolute humidity.

DETAILED DESCRIPTION OF THE PREFERRED EMBODIMENTS

In the following, embodiments of the present invention will be described in detail referring to accompanying drawings. It should be noted that in the figures, the same numeral is assigned to the same part or a corresponding part, and a duplicated description is simplified or omitted accordingly.

Embodiment 1

Embodiment 1 of the present invention will be described in detail referring to FIGS. 1-10.

First, referring to FIG. 1, a configuration and an operation of an entire image forming apparatus will be described.

Figure 1:
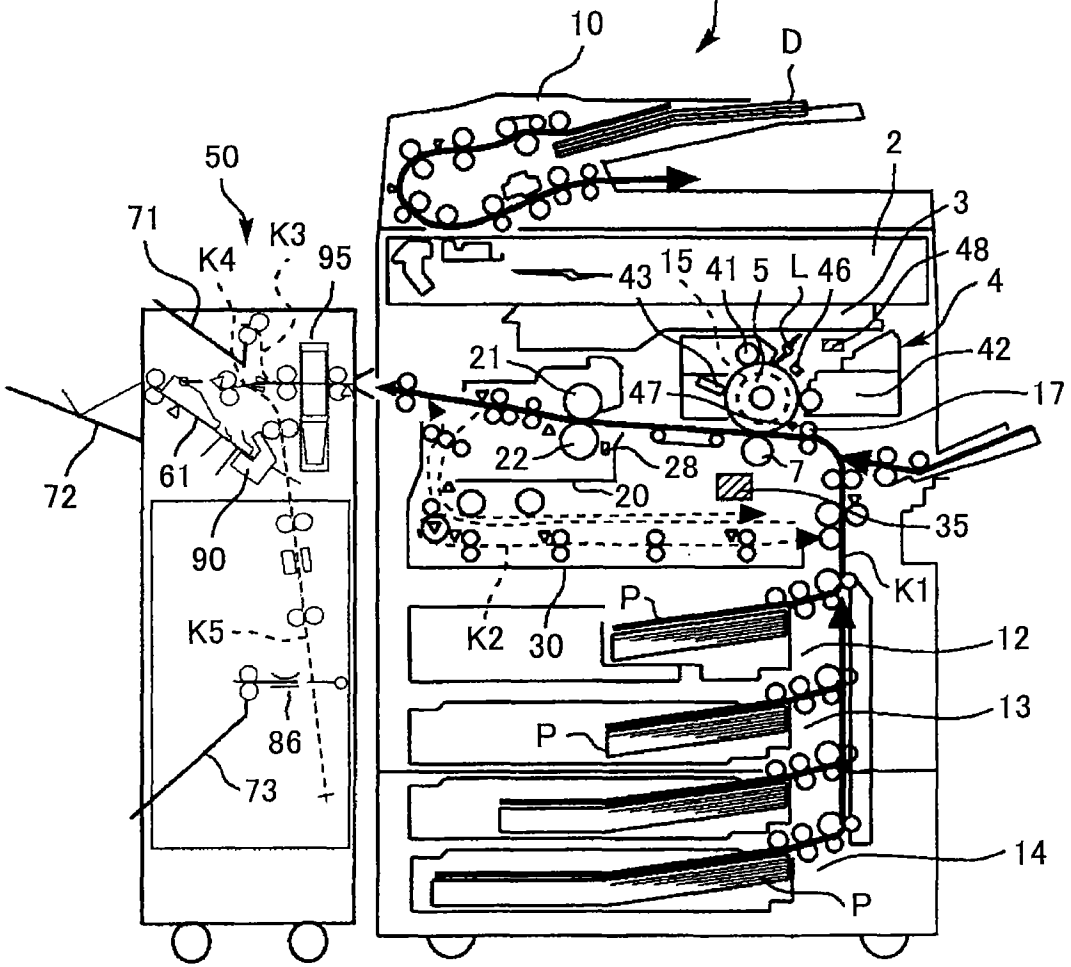
FIG. 1 is an overall configuration diagram illustrating an image forming apparatus according to an embodiment 1 of the present invention.

In FIG. 1, numeral 1 denotes a copier as an image forming apparatus, numeral 2 denotes a document reading unit for optically reading image information of a document D, numeral 3 denotes an exposure unit for irradiating a photoconductor drum 5 (image bearer) with exposure light L based on the image information read by the document reading unit 2, numeral 4 denotes an image formation unit for forming a toner image (image) on the photoconductor drum 5, numeral 7 denotes a transfer roller (transfer rotation body) for transferring the toner image formed on the photoconductor drum 5 onto a recording medium P (paper), numeral 10 denotes a document conveyance unit for conveying the set document D to the document reading unit 2, numerals 12-14 denote sheet-feeding units in which a recording medium P such as transfer paper is stored, numeral 15 denotes a drive motor as a drive unit for driving a driven member such as the photoconductor drum 5, numeral 17 denotes a registration roller (timing roller) for conveying the recording medium P towards a transfer nip unit where the transfer roller 7 abuts the photoconductor drum 5, numeral 20 denotes a fixing device for fixing a not-yet-fixed image on the recording medium P, numeral 21 denotes a fixing belt (fixing member) installed in the fixing device 20, numeral 22 denotes a press roller (press member) installed in the fixing device 20, numeral 30 denotes a two-side conveyance unit for turning over the recording medium P having an image formed on a front surface thereof and conveying it towards an image forming unit again, numeral 46 denotes a surface potential meter for measuring a surface potential of the photoconductor drum 5, and numeral 47 denotes an image density detection sensor (photo sensor) for optically detecting image density of the toner image (patch pattern) formed on the photoconductor drum 5.

Also, numeral 50 denotes a post-processing device (paper processing device) for applying a post-process to the recording medium P ejected and fed from the image forming apparatus body 1, numeral 61 denotes a stacking unit (internal tray) installed inside the post-processing device 50, numerals 71-73 are trays (ejected paper tray) in which the recording medium P (or stack of paper) after the post-process is ejected and stacked, numeral 86 denotes a folding-in-the-middle plate for a folding process installed inside the post-processing device 50, numeral 90 denotes a binding device (staple process unit) installed inside the post-processing device 50, and numeral 95 denotes a perforating device (punch process unit) installed inside the post-processing device 50. The post-processing device 50 is detachably installed in the image forming apparatus body 1.

Referring to FIG. 1, the image formation unit 4 includes the photoconductor drum 5 as an image bearer, a charging roller 41 (charging device), a developing device 42, the transfer roller 7 as a transfer rotation body, a cleaning device 43, etc.

To describe in detail, the photoconductor drum 5 as an image bearer is a negative charge organic photoconductor in which a photosensitive layer is arranged on a drum-shaped conductive support. Not shown in figures, in the photoconductor drum 5, on top of the conductive support as a base layer, an undercoat layer which is an insulating layer, a charge generation layer as a photoconductor, and a charge transport layer are laminated in this order. The photoconductor drum 5 is a driven member which is driven by the drive motor 15 as a drive unit during an image forming operation and rotates (runs) in a predetermined direction (clockwise direction in FIG. 1).

The charging roller 41 is a roller member in which a periphery of a conductive cored bar is covered by an elastic layer of a medium resistance, and is arranged to abut the photoconductor drum 5. A predetermined charging bias is applied to the charging roller 41 (charging device) from a charging power supply unit (not shown in the figure), which causes the surface of the opposed photoconductor drum 5 to be uniformly charged.

The developing device 42 mainly includes a developing roller as a developer bearer opposed to the photoconductor drum 5, two conveyance screws installed in parallel and separated by a partition member, and a doctor blade opposed to the developing roller. The developing roller includes a magnet which is fixed inside the roller, forming a magnetic pole on a circumferential surface of the roller, and a sleeve rotating around the magnet. The magnet forms multiple magnetic poles on the developing roller (sleeve) and, as a result, a developer is borne on the developing roller. In the developing device 42, a two-component developer consisting of carrier and toner is contained. Also, not shown in the figure, a toner container (in which brand-new toner is contained) is detachably (replaceably) installed in the developing device 42.

With the developing device 42 configured as described above, in a position where the developing roller opposes the photoconductor drum 5 (which is a developing area), toner on the developing roller is moved by an electric field formed in the developing area toward an electrostatic latent image formed on the photoconductor drum 5. In this way, a desired toner image is formed on the photoconductor drum 5.

Here, in the present embodiment 1, the developing device 42 is configured to be driven by the drive motor 15 (drive unit) which rotationally drives the photoconductor drum 5 during an image forming operation. In other words, not only is the photoconductor drum 5 rotationally driven by a drive force transferred to the photoconductor drum 5 from the drive motor 15, but also a rotation member such as the developing roller and the conveyance screws of the developing device 42 are rotationally driven by drive force transferred via a gear train from the drive motor 15. In this way, the developing device 42 functions as a driven member which is driven by the drive motor 15 as a drive unit. It should be noted that, in the present embodiment 1, another configuration member other than the photoconductor drum 5 and the developing device 42 may also be driven as a driven member by the drive motor 15 (drive unit).

It should be noted that the toner used in the present embodiment 1 is one for a high-speed machine, and is a low melting point toner.

Specifically, the toner used in the present embodiment 1 includes a binder resin, the binder resin including at least a crystalline polyester resin (A), a non-crystalline resin (B), a non-crystalline resin (C) and a composite resin including a condensation polymerization resin unit and an addition polymerization resin unit (D), the non-crystalline resin (B) including chloroform insoluble matter, softening temperature (T1/2) of the non-crystalline resin (C) being higher than the non-crystalline resin (B) by 25° C. or more, molecular weight distribution by GPC obtained by THF solubles of the toner having a main peak between 1000 and 10000, and half value width of the molecular weight distribution being set at 15000.

This kind of toner has a low melting point and is well suited as toner for a high-speed image forming apparatus. On the other hand, in this kind of toner, the charge amount being decreased by adhering paper dust, the toner tends to easily adhere to the transfer roller 7. As a result, the present invention described later is especially beneficial for this kind of toner (beneficial in that the toner adhering to the transfer roller 7 is effectively removed).

In the cleaning device 43, a cleaning blade is installed for removing adhering matter which has abutted the photoconductor drum 5 and has adhered to the surface of the photoconductor drum 5 (the adhering matter is mainly untransferred toner). The cleaning blade includes a plate-like blade body made of a rubber material such as an urethane rubber, a hydrin rubber, a silicon rubber, a fluorine-containing rubber, or the like, held by a holding plate. The cleaning blade abuts the surface of the photoconductor drum 5 with a predetermined angle and a predetermined pressure. With the above arrangement, the untransferred toner adhering to the photoconductor drum 5 is mechanically removed and collected in the cleaning device 43.

It should be noted that, in the present embodiment 1, a recycle route may be established for supplying as recycle toner the untransferred toner removed and collected by the cleaning device 43 to the developing device 42.

The transfer roller 7 as a transfer rotation body is a roller member in which a periphery of a conductive cored bar is covered by an elastic layer of a resistance value (a resistance value when DC voltage 100 V is applied with temperature and humidity 23° C. 50% RH) from $10^6$ to $10^9\Omega$, and abuts the photoconductor drum 5 to form a transfer nip unit. Also, the transfer roller 7, being driven by a drive force input by the drive motor 15 via a gear train, rotates in a predetermined direction (counterclockwise direction in FIG. 1).

It should be noted that while the transfer roller 7 is rotationally driven by the drive motor 15 for the photoconductor drum 5 in the present embodiment 1, the transfer roller 7 may be rotationally driven by another drive motor, or the transfer roller 7 may be rotationally driven by frictional force with the photoconductor drum 5 without drive force input from a drive motor.

Also, the image forming apparatus 1 includes a power supply unit 35 (power supply unit for the transfer roller) as a bias applying unit for applying a transfer bias to the transfer roller 7 (transfer rotation body) to transfer the toner image borne by the photoconductor drum 5 onto the recording medium P conveyed to the transfer nip unit. To describe in detail, a predetermined transfer bias (a bias with a polarity different from the toner's polarity, which is a bias with positive polarity in the present embodiment 1) is applied to the transfer roller 7 (transfer rotation body) from the power supply unit 35 and the toner image (image) on the photoconductor drum 5 is transferred onto the recording medium P conveyed to (nipped by) the transfer nip unit.

It should be noted that the power supply unit 35 (bias applying unit) in the present embodiment 1 is a current source configured to apply a transfer bias to the transfer roller 7 using constant current control. In a transfer apparatus performing constant current control described above, the transfer bias applied to transfer roller 7 is adjusted in order to make a current value constant which flows during the sheet passing. Then, by providing a reverse charge different from polarity of the toner to a back surface (a surface onto which the toner image will not be transferred) of the recording medium P, the toner image on the photoconductor drum 5 is electrically drawn to the front surface of the recording medium P.

Then, in a transfer apparatus with a direct transfer system in which a transfer nip unit is formed between the photoconductor drum 5 and the transfer roller 7 and the toner is transferred directly onto the recording medium 5 from the photoconductor drum 5, the photoconductor drum 5 directly contacts the transfer roller 7 in a state where there is no recording medium P nipped by the transfer nip unit. As a result, if a transfer bias is applied to the transfer roller in that state, then a background-fog toner (toner adhering to a non-image area of the photoconductor drum 5, to which the toner is not expected to adhere, due to insufficient charging of the toner or due to mechanically applied pressure) adhering to the surface of the photoconductor drum 5 may move and adhere to the transfer roller 7 so that the transfer roller 7 is stained with the toner. If the transfer roller 7 is stained with the toner, then the toner adheres to the back surface or the edge surface of the recording medium P conveyed to the transfer nip unit.

Therefore, in the present embodiment 1, as will be described later, the toner is prevented from adhering to the transfer roller 7 by controlling the transfer current not to flow in the transfer roller 7 during the between-sheets time, or by applying a cleaning bias; or the toner which has adhered to the transfer roller 7 is moved to the photoconductor drum 5 and cleaned.

Referring to FIG. 1, operations during normal image forming (image forming operations) will be described.

First, a document D is conveyed by a conveyance roller of a document conveyance unit 10 in a direction indicated by an arrow in the figure from a platen and passes over the document reading unit 2. Here, in the document reading unit 2, image information of the document D passing over the document reading unit 2 is optically read.

Then, the image information optically read in the document reading unit 2, after being converted to an electrical signal, is transmitted to the exposure unit 3 (writing unit). Then, from the exposure unit 3, exposure light L such as laser light based on the electrical signal of the image information is emitted in a main-scanning direction towards the photoconductor drum 5 of the image formation unit 4 by a polygon mirror rotationally driven by a drive motor (not shown) for the exposure unit 3.

On the other hand, in the image formation unit 4, the photoconductor drum 5 is, by receiving drive force from the drive motor 15, rotating in a clockwise direction in the figure, and, after going through predetermined image formation processes (a charging process, an exposure process, and a developing process), an image (toner image) corresponding to the image information is formed on the photoconductor drum 5.

Then, the image formed on the photoconductor drum 5 is, at the transfer nip unit including the transfer roller 7, transferred onto the recording medium P which has been conveyed by the registration roller 17.

On the other hand, the recording medium P, which is conveyed to a position of the transfer roller 7 (transfer nip unit), operates as follows.

First, from multiple sheet-feeding units 12, 13, and 14 of the image forming apparatus body 1, one sheet-feeding unit is automatically or manually selected (for example, it is assumed that the uppermost sheet-feeding unit 12 is selected).

Then, an uppermost sheet of the recording medium P contained in the sheet-feeding unit 12 is conveyed towards a position of conveyance route K1.

Then, the recording medium P passes through the conveyance route K1 where multiple conveyance rollers are arranged and arrives at a position of the registration roller 17. Then, the recording medium P having arrived at the position of the registration roller 17 is, at a timing for aligning with the image formed on the photoconductor drum 5, conveyed towards the transfer nip unit (transfer roller 7).

Then, the recording medium P after the transfer process, and after passing through a position of the transfer nip unit and going through the conveyance route, arrives at the fixing device 20. The recording medium P which has arrived at the fixing device 20 is conveyed between the fixing belt 21 and the press roller 22 and an image is fixed by heat received from the fixing belt 21 and pressure received from the fixing belt 21 and the press roller 22. The recording medium P with the fixed image is, after being sent out from between the fixing belt 21 and the press roller 22, ejected from the image forming apparatus body 1.

It should be noted that in the case where "two-sided print mode" in which the printing is performed on two sides (front surface and back surface) of the recording medium P is selected, the recording medium P, whose fixing process for the front surface has been finished, is not ejected as in the case where the above described "one-side print mode" is selected; but instead, is guided by a two-sided conveyance route K2. After the conveyance direction has been reversed at a two-sided conveyance unit 30, the recording medium P is conveyed towards a position of the transfer nit unit (transfer roller 7) again. Then, at the position of the transfer nip unit, by the similar image forming process (image forming operation) as described above, an image formation is performed on the back surface of the recording medium P, and, after going through the fixing process at the fixing device 20 and going through the conveyance route, the recording medium P is ejected from the image forming apparatus body 1.

Here, in the image forming apparatus according to the present embodiment 1, the post-processing device 50 is arranged in the image forming apparatus body 1 so that the recording medium P ejected from the image forming apparatus body 1 is conveyed to the post-processing device 50 and a post-process is performed for the conveyed recording medium P.

Figure 2:
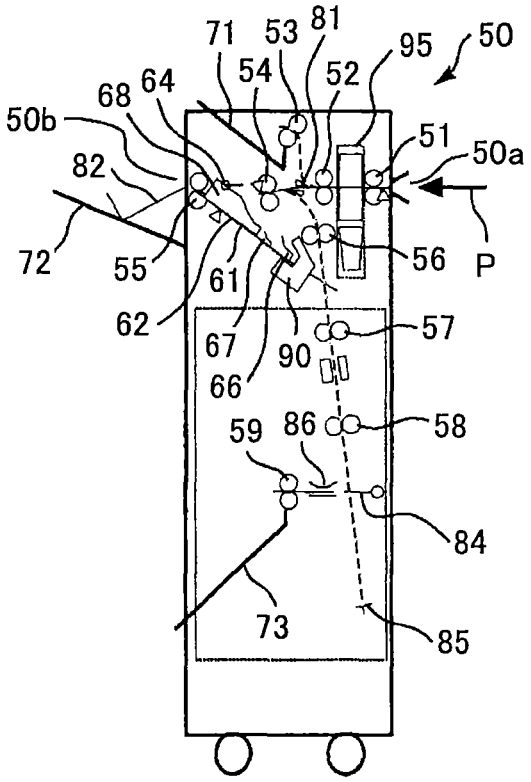
FIG. 2 is a configuration diagram illustrating a post-processing device.

Referring to FIG. 1 and FIG. 2, the post-processing device 50 in the present embodiment 1 is configured to convey the recording medium P conveyed from the apparatus body 1 to any one of three conveyance routes K3 through K5 so that different post-processes can be performed. The first conveyance route K3 is a conveyance route either for ejecting the recording medium P without performing any post-process into a first paper ejection tray 71 or for ejecting the recording medium P after performing only a punch process using a punching device 95 into the first paper ejection tray 71. The second conveyance route K4 is a conveyance route for loading the recording medium P conveyed from the image forming apparatus body 1 in a stacking unit 61 (internal tray), performing a binding process on a trailing edge of paper using a binding device 90, and ejecting the process-performed recording medium P (sheet bundle PT) from a paper ejection opening 50*b* towards an external tray 72 (second paper ejection tray) by using a paper ejection roller 55. The third conveyance route K5 is a conveyance route for, first, conveying the recording medium P conveyed from the image forming apparatus body 1 to the second conveyance route K4, then switching back, performing a folding process using a folding-in-the-middle plate 86, a paper folding blade 84, etc., and ejecting into the third paper ejection tray 73.

It should be noted that the switching among the above described three conveyance routes K3-K5 can be performed by a switching operation (rotation) of a branch nail 81. Also, it should be noted that when the recording medium P is conveyed using the second conveyance route K4 or the third conveyance route K5, similar to the case where the recording medium P is conveyed using the first conveyance route K3, the punch process by a punching device 95 may be performed.

To describe further in detail, referring to FIG. 2, there is a first conveyance roller 51 and a paper detection sensor arranged near a conveyance entrance 50*a* of the post-processing device 50 so that the recording medium P detected by the paper detection sensor is conveyed into the device 50 by the first and a second conveyance rollers 51 and 52. In this case, if the punch process is selected beforehand by a user, then the punch process by the punching device 95 will be performed to the recording medium P.

Then, based on the mode of the post-process selected by the user beforehand, the branch nail 81 rotates so that the recording medium P will be guided to the desired conveyance routes K3-K5.

In the case where a mode of no post-process is selected, the recording medium P conveyed to the first conveyance route K3 is ejected by a third conveyance roller 53 to the first paper ejection tray 71.

In the case where "sort mode (sorting process mode)" is selected, the recording media P conveyed to the second conveyance route K4 are conveyed by a fourth conveyance roller 54 movable in a paper-width direction (direction perpendicular to the plane of the paper in FIG. 2). The recording media P are conveyed, at the same time being individually shifted by a predetermined amount in the paper-width direction, conveyed by a paper ejection roller 55 (fifth conveyance roller), and stacked in order in an external tray 72 (second paper ejection tray).

Referring again to FIG. 2, a filler 82 is arranged above the external tray 72. The filler 82 is capable of rotating around a shaft at the upper end of the filler 82. The external tray 72 is capable of moving upwards and downwards by a moving mechanism (not shown in the figure). Also, height of the recording media P stacked in the external tray 72 can be detected by a sensor arranged near the shaft of the filler 82 which detects a state in which the filler 82 is touched by a conveyance direction center part of the recording media P stacked in order in the external tray 72. Also, according to increase or decrease of the number of sheets of the recording medium P stacked in the external tray 72, a position of the external tray 72 in the up-and-down direction is adjusted. Also, in the case where the position of the external tray 72 in the up-and-down direction has reached the lowest, assuming that the number of sheets of the recording medium P stacked in the external tray 72 has reached the maximum (full), a stop signal is transmitted from the post-processing device 50 to the image forming apparatus 1 in order to stop image forming operations. It should be noted that as long as a series of post-processing operations including the above described post-processes and post-processes described below at the post-processing device 50 are being performed, the image forming apparatus body 1 is continuously operating, and even when an actual image formation process is not being performed on the photoconductor drum 5, image formation members such as the photoconductor drum 5 and the transfer roller 7 are being driven in vain.

In the case where "binding process mode (staple mode)" is selected, the recording media P conveyed by the second conveyance route K4 are conveyed by the fourth conveyance roller 54 without being shifted, and stacked in order in the stacking unit 61 (internal tray). Then, when a predetermined number of sheets of the recording medium P (sheet bundle) is stacked on a mounting surface 62 of the stacking unit 61, a hitting roller 64 arranged above the stacking unit 61 moves to a position where the hitting roller 64 touches the uppermost of the recording media P, and, by the hitting roller 64 being rotationally driven in the counterclockwise direction in FIG. 2, the multiple number of sheets of the recording medium P (sheet bundle) is conveyed (moved) towards a fence unit 66. With the above operation, ends (ends in the conveyance direction) of the multiple number of sheets of the recording medium P (sheet bundle) bump into the fence unit 66 and positions of the multiple number of sheets of the recording medium P are aligned in the conveyance direction.

Here, referring to FIG. 2, jogger fences 68 arranged at both ends in the width direction of the stacking unit 61 move in the width direction to sandwich the multiple number of sheets of the recording medium P stacked in the stacking unit 61. As a result, positions of the multiple number of sheets of the recording medium P are aligned in the width direction. Then, the ends of the recording media P (sheet bundle) whose positions in the conveyance direction and the width direction have been aligned are provided with a binding process by the binding device 90.

Then, the recording media P (sheet bundle) to which the binding process has been provided are moved obliquely upward along the tilt of the mounting surface 62 by a movement of a releasing nail 67 in the paper ejection direction, and, by being conveyed by the paper ejection roller 55, ejected into the external tray 72.

In the case where "folding process mode" is selected, first, the recording medium P is conveyed to the second conveyance route K4, then, the switch back is performed by, with the end part of the recording medium P being nipped by the fourth conveyance roller 54, rotating the fourth conveyance roller 54 in the reverse direction, and the recording medium P is conveyed to the third conveyance route K5. Then, the recording medium P conveyed to the third conveyance route K5 is conveyed by sixth through eighth conveyance rollers 56-58 to a position where the center part of the recording medium P is opposed to the paper folding blade 84. Here, the recording medium P is in a state where the top portion of the recording medium P bumps into a stopper unit 85 (configured to move in the conveyance direction by a slide mechanism which is not shown in the figure). Then, a desired number of sheets of the recording medium P (sheet bundle) are stacked in that position.

Then, the recording media P (sheet bundle) are provided with a folding-in-the-middle process by, in a state where the recording media P are folded in the middle by the paper folding blade 84 which moves to the left in FIG. 2, being pressed at a position of the folding-in-the-middle plate 86. Then, the recording media P (sheet bundle) after the folding process are conveyed by a ninth conveyance roller 59 and ejected into the third paper ejection tray 73.

Here, the fixing device 20 arranged in the image forming apparatus body 1 according to the present embodiment 1 includes a fixing belt 21 as a fixing member, a metal pipe which is not shown in the figure and is arranged to be opposed to an inner periphery of the fixing belt 21, a halogen heater which is not shown in the figure and is arranged in the hollow portion of the metal pipe, a fixed member which is not shown in the figure, arranged in the fixing belt 21, and pressed via the fixing belt 21 against a press roller 22 forming a fixing nip unit, the press roller 22 being a press member, a temperature sensor which detects surface temperature of the press roller 22, etc.

The fixing belt 21 is a thin and flexible endless belt and is rotated (runs) in the clockwise direction in FIG. 1 by frictional force received at the fixing nip unit. The fixing belt 21 includes an elastic layer and a releasing layer laminated in order on top of base material and the entire thickness of the fixing belt 21 is equal to or less than 1 mm.

An output of the halogen heater arranged inside the fixing belt 21 is controlled based on a detection result of surface temperature of the fixing belt 21 detected by a thermistor opposed to the surface of the fixing belt 21. Then, the fixing belt 21 is heated to desired temperature (fixing temperature) by the radiation heat of the halogen heater via the metal pipe. Then, the heat is applied from the surface of the heated fixing belt 21 to a toner image on the recording medium P and the toner image on the recording medium P is fixed.

The press roller 22 as a press member includes a cored bar of a hollow structure made of stainless steel or aluminum on which an elastic layer made of foamed silicone rubber or silicone rubber is formed, which cored bar is rotationally driven in the counterclockwise direction in FIG. 1 by a drive motor (not shown in the figure) for the fixing device 20.

Figure 3:
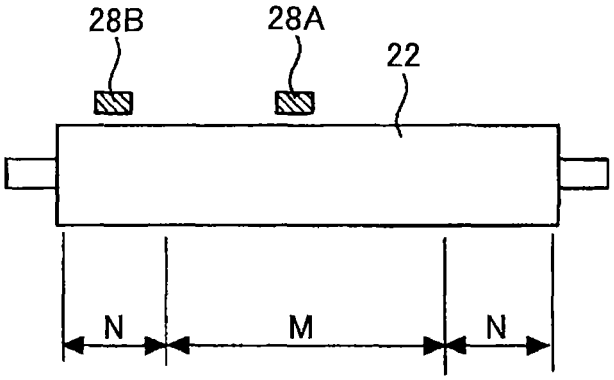
FIG. 3 is a schematic diagram illustrating a press roller of a fixing device shown in the width direction.

Here, in the present embodiment 1, as shown in FIG. 3, two temperature sensors 28A and 28B are arranged at a center part and an end part in the width direction of the press roller 22, respectively, as temperature sensors for detecting surface temperature of the press roller 22. The first temperature sensor 28A is for detecting the temperature at the center part in the width direction of the press roller 22 and the second temperature sensor 28B is for detecting the temperature at the end part in the width direction of the press roller 22. Then, in the case where small-size sheet as the recording medium P continuously passes the press roller 22, the first temperature sensor 28A detects temperature of the press roller 22 corresponding to a paper-passing area M on which the small-size sheet passes, the second temperature sensor 28B detects temperature of the press roller 22 corresponding to a non-paper-passing area N on which the small-size sheet does not pass, and if it is detected by comparing the detection results that the non-paper-passing area N is in an excessive temperature rise state, then the between-sheets time before large-size sheets as recording media P continuously pass is controlled to be set long (fixing temperature adjusting mode). With the above control, in a fixing process for the large-size sheet, a problem in which a fixing failure occurs such as a hot offset at both ends in the width direction (corresponding to non-paper-passing area N for the small-size sheet) can be alleviated. In particular, the fixing device 20 in the present embodiment 1 is an energy-saving type fixing device whose heat-transfer efficiency from a heat source (heater) to a fixing member is high. As a result, heat diffusion amount in the width direction of the fixing member is small and it is easy for an excessive temperature rise to occur; thus, the above fixing temperature control mode is useful. It should be noted that the control of the power supply unit for the transfer roller 35 in the fixing temperature adjusting mode will be described later using FIG. 6.

It should be noted that, in the present embodiment 1, the temperature sensors 28A and 28B are arranged opposed to the center part and the end part in the width direction of the press roller 22, respectively, to detect a temperature condition of the non-paper-passing area N of the fixing device 20. On the contrary, the temperature sensors 28A and 28B may be arranged opposed to the center part and the end part in the width direction of the fixing belt 21, respectively, to detect a temperature condition of the non-paper-passing area N of the fixing device 20.

Also, in the present embodiment 1, the fixing device 20 is used, in which the fixing belt is used as a fixing member, the press roller is used as a press member, and the halogen heater is used as a heating unit. But a fixing device of various types may be used. For example, a fixing device may be used, in which a fixing roller is used as a fixing member, another fixing device may be used, in which a press belt is used as a press member, and yet another fixing device may be used, in which an exciting coil or a resistance heating element is used as a heating unit.

In the following, referring to FIGS. 4 through 10, configurations and operations of the image forming apparatus 1 which are characteristic in the present embodiment 1 will be described in detail.

FIGS. 4A-4D are timing charts illustrating control of the power supply unit 35 (bias applying unit) for the transfer roller 7 and control of a drive motor 15 (driving unit) during continuous sheet passing.

The power supply unit 35 (refer to FIG. 1) as a bias applying unit in the present embodiment 1 is configured to apply, in addition to a transfer bias which is applied in a normal transfer process, a cleaning bias for cleaning (removing) the toner adhered to the transfer roller 7 (transfer rotation body) and a non-image area bias whose absolute value is less than the cleaning bias to the transfer roller 7 accordingly. To describe in detail, the power supply unit 35 is configured to vary a value of transfer current which flows in transfer roller 7. Specifically, the transfer current applied from the power supply unit 35 to the transfer roller 7 is varied accordingly by the control of the control unit (control unit) in which a CPU, a RAM, a ROM, etc., are arranged. It should be noted that, as shown in FIGS. 4A-4D, in the present embodiment 1, the non-image area bias (transfer current) is set to 0 μA. Also, the control in which the cleaning bias is applied to the transfer roller 7 is accordingly called "cleaning mode" in the following. Also, the drive motor 15 as a drive unit can switch its driving state including a state in which a driven member such as the photoconductor drum 5 and the developing device 42 is driven, and a state in which the driving is stopped (the drive motor 15 can be switched between ON and OFF). In particular, controlling to stop driving the driven member during between-sheets time is accordingly called "drive OFF mode" in the following.

Here, in the present embodiment 1, when the photoconductor drum 5 (image bearer) is being driven and multiple sheets of the recording medium P are continuously conveyed (continuous sheet passing time), between-sheets time, which is defined by the time from when the recording medium P is ejected from the transfer nip unit to when the next recording medium P is conveyed to enter the transfer nip unit, and which is denoted as time X, is controlled to vary based on a predetermined condition. In other words, between-sheets time X (ms) is a variable varying based on the predetermined condition.

Figure 4A:
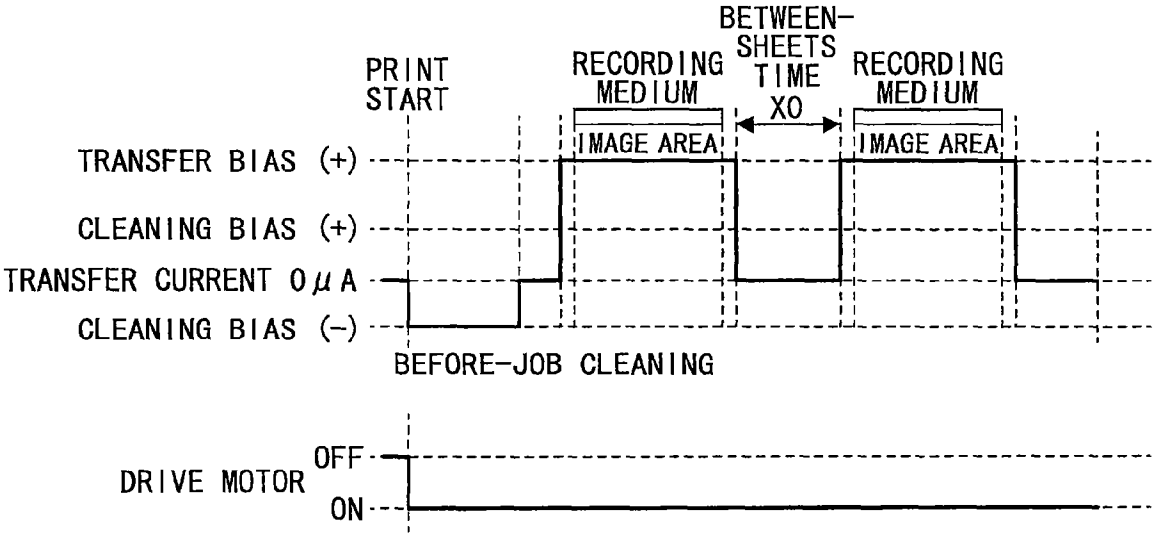
FIGS. 4A-4D are timing charts illustrating control of a power supply unit for a transfer roller and a drive motor.

Also, as shown in FIG. 4A, in the case where the time X (between-sheets time X0) is equal to or less than a threshold value A (in the case where X≤A), the power supply unit 35 for the transfer roller (bias applying unit) is controlled to apply non-image area bias (0 μA) during all of the time X (between-sheets time X0). Also, the drive motor 15 (drive unit) is controlled in such a way that during all of the time X (between-sheets time X0), the driven member such as the photoconductor drum 5 and/or the developing device 42 is driven by drive motor 15 (the drive motor 15 is controlled in such a way that it is in an ON state continuously including the between-sheets time).

Figure 4B:
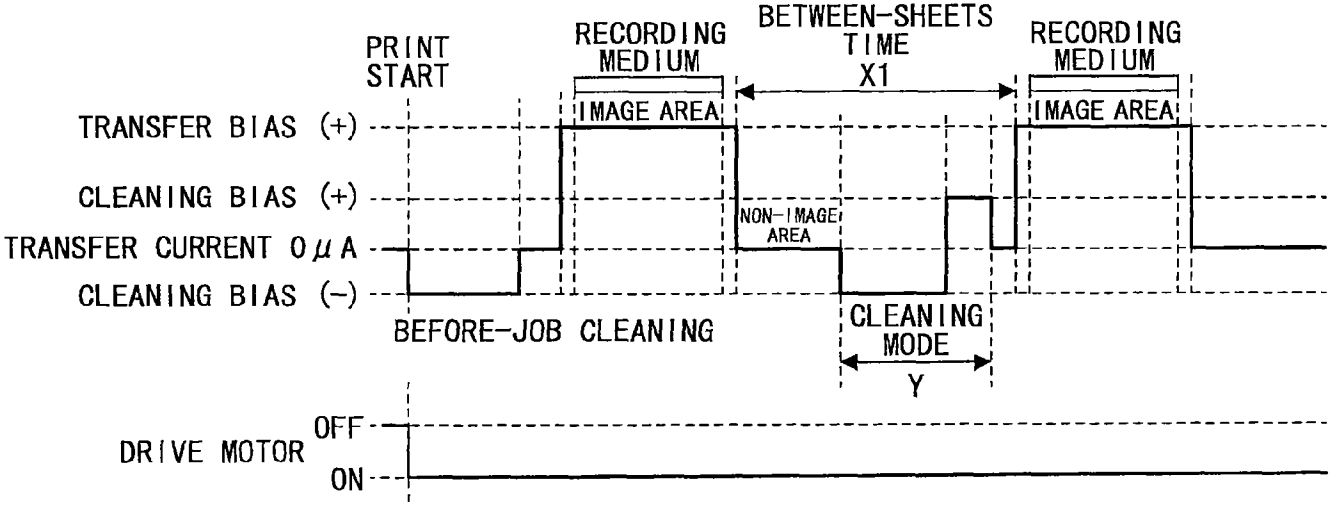
Figure 4C:
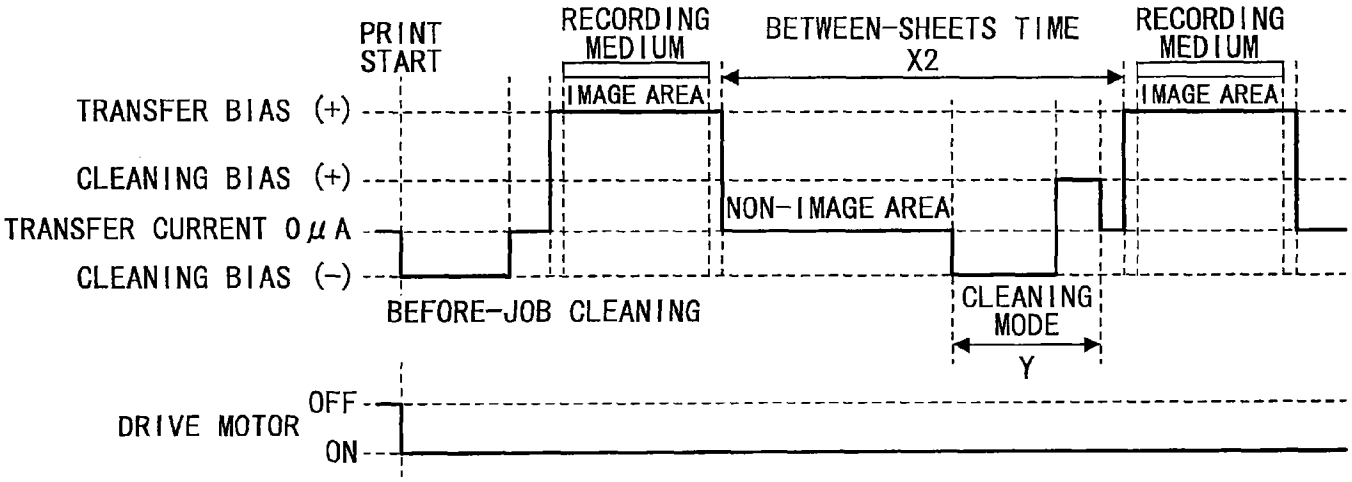

On the other hand, as shown in FIGS. 4B and 4C, in the case where the time X (between-sheets times X1 and X2) exceeds the threshold value A and does not exceed a threshold value B (>A) which is greater than the threshold A (in the case where A<X≤B), during the time X (between-sheets times X1 and X2), the power supply unit 35 for the transfer roller is controlled in such a way that the non-image area bias (0 pμA) is applied during time Z and the cleaning bias is applied during time (X−Z). Also, the drive motor 15 (drive unit) is controlled in such a way that during all of the time X (between-sheets times X1 and X2), the driven member such as the photoconductor drum 5 and the developing device 42 is driven by drive motor 15 (the drive motor 15 is controlled in such a way that it is in an ON state continuously including the between-sheets time).

Figure 4D:
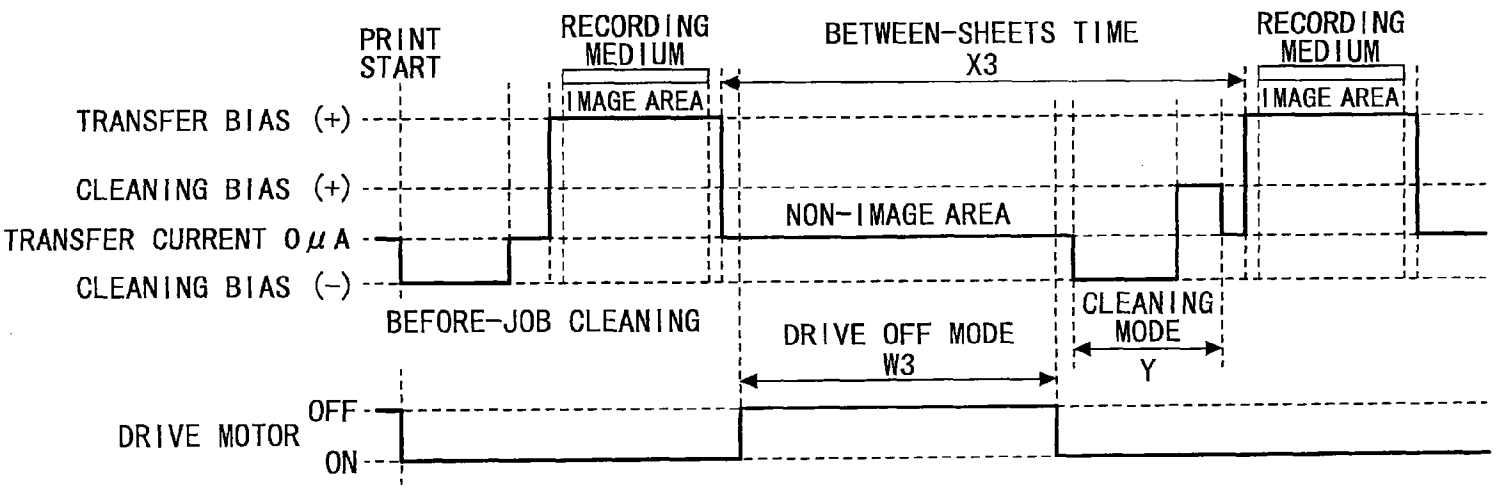

Furthermore, as shown in FIG. 4D, in the case where the time X (between-sheets time X3) exceeds the threshold value B (in the case where X>B), the power supply unit 35 for the transfer roller is controlled in such a way that, within the time X (between-sheets time X3), non-image area bias 0 μA is applied during time Z, which is equivalent to the bias application being OFF (or, the bias application is OFF so that none of the transfer bias, the cleaning bias, and the non-image area bias is applied) and the cleaning bias is applied during the time (X−Z). Also, the drive motor 15 (drive unit) is controlled in such a way that, within the time X (between-sheets time X3), during the time W, driving the driven member such as the photoconductor drum 5 and the developing device 42 is stopped, and during the time (X−W), driving the driven member such as the photoconductor drum 5 and the developing device 42 is performed (the drive motor 15 is controlled in such a way that it is in an OFF state during the time W3 within the between-sheets time and it is in an ON state during the remaining time).

In other words, in the case where the between-sheets time X is short, during the between-sheets time, the cleaning mode is not performed and the stopping of driving the photoconductor drum 5 and the developing device 42 (drive-OFF mode) is not performed. On the other hand, in the case where the between-sheets time X is of a medium length, during the between-sheets time X, the cleaning mode is performed but the stopping of driving the photoconductor drum 5 and the developing device 42 (drive-OFF mode) is not performed. Furthermore, in the case where the between-sheets time X is long, during the between-sheets time X, the cleaning mode is performed and the stopping of driving the photoconductor drum 5 and the developing device 42 (drive OFF mode) is also performed.

Here, in the present embodiment 1, the power supply unit is controlled in such a way that the longer the time X (between-sheets time) is, the longer the time Z (non-image area bias applying time during the between-sheets time) is.

Also, in the case where the cleaning mode is performed, the time when the cleaning mode is performed (X−Z) is a fixed time Y (fixed value) regardless the length of the time X (between-sheets time).

Therefore, in other words, in the present embodiment 1, assuming that the between-sheets time in the continuous sheet passing time is a variable X (ms) and the "cleaning mode" performance time during which the cleaning bias is applied to the transfer roller 7 is a fixed value Y (ms), in the case where a value (X−Y) in which the fixed value Y is subtracted from the variable X varied according to a predetermined condition exceeds a predefined threshold value α (ms) (in the case where X−Y>α), the cleaning mode is controlled to be performed during the between-sheets time X. Also, a relationship A=Y+α is satisfied by the threshold value α and the threshold value A.

Specifically, as shown in FIGS. 4B-4D, when paper passing is performed during between-sheets times X1, X2, or X3 (>Y+α(=A)) where the relation (between-sheets time X)−(cleaning mode performing time Y)>(threshold value α) is satisfied, the cleaning mode is performed during the time Y within the between-sheets time X. In other words, when the relationship of the above formula is satisfied, the cleaning mode is performed during the same time Y regardless the length of the between-sheets time X. Also, within the between-sheets time X, during the time Z other than time Y (Z=X−Y), the non-image area bias of 0 μA (0 V) is applied (or, applying the bias is OFF so that none of the transfer bias, the cleaning bias and the non-image area bias is applied). It should be noted that the time when the non-image area bias is applied, which is equivalent to the bias application OFF state, is accordingly referred to "bias application OFF time".

On the other hand, as shown in FIG. 4A, when the sheet passing is performed during between-sheets time X0 (≤Y+α(=A)) where the relation of the above formula is not satisfied, the cleaning mode is not performed during the between-sheets time X.

It should be noted that the cleaning mode performing time Y in the above formula is, in the case where the cleaning mode is performed multiple times within one between-sheets time, the total sum of the multiple times.

Here, the threshold value A (fixed value Y+threshold value α) is a value predefined by taking into account, in addition to the actual cleaning mode performing time Y, a case where a conveyance position misalignment of the recording medium P occurs at the transfer nip unit, and time required for switching the bias applied to the transfer roller 7. If the threshold value A is too small, then there is a possibility that the timing when the recording medium P is conveyed to or out from the transfer nip unit and the timing of the cleaning mode may overlap and a failure may occur in which outputting an image area may not be performed in time. If the threshold value A is too large, then there is a possibility that frequency of performing the cleaning mode may decrease. Therefore, it is necessary to determine an appropriate value for the threshold value A.

Also, a threshold value B which is a determination criteria for determining whether the controlling the drive motor 15 (drive unit) to be in an OFF state (drive OFF mode) during the between-sheets time should be performed is a value predefined by taking into account, in addition to the threshold value A (fixed value Y+threshold value α), time for turning OFF the drive motor 15 (turning the drive motor 15 into an OFF mode) and time for turning ON the drive motor 15 (turning the drive motor 15 into an ON state). If the threshold value B is too small, then there is a possibility that a failure may occur in which the time required for turning OFF/ON the drive motor 15 (drive OFF/ON time) cannot be secured. If the threshold value B is too large, then there is a possibility that frequency of performing the drive OFF mode may decrease. Therefore, it is necessary to determine an appropriate value for the threshold value B.

Specifically, as shown in FIG. 4D, when the sheet passing is performed during between-sheets time X3 (>Y+α+β(=B)) where the relation (between-sheets time X)>(cleaning mode performing time Y)+(threshold value α)+(drive OFF/ON time β) is satisfied, the drive OFF mode is performed as long as time W3 in the time Z (bias application OFF time) within the between-sheets time. On the other hand, as shown in FIGS. 4A-4C, when the sheet passing is performed during between-sheets times X0, X1, X2 (≤Y+α+β (=B)) where the relation of the above formula is not satisfied, the drive OFF mode is not performed during the between-sheets time.

In this way, in the present embodiment 1, even in the case where the between-sheets time is a long period of time, the cleaning bias is applied to the transfer roller 7 and the toner adhered to the transfer roller 7 can be moved to (adhered to) the photoconductor drum 5 again during the between-sheets time. Thus, a failure can be reliably alleviated in which the back surface or the edge surface of the recording medium P gets dirty. Also, because the cleaning mode is performed only when the time Y for applying the cleaning bias can be secured within a given between-sheets time X and the between-sheets time X is not controlled to be intentionally set to be longer in order for the cleaning mode to be performed, a failure does not occur in which productivity during the continuous sheet passing is reduced due to the cleaning mode.

Also, because, in the case where the cleaning mode is performed, even when the between-sheets time X is a long period of time, the time Y for applying the cleaning bias to the transfer roller 7 is limited to a fixed value, a failure can be alleviated in which damage (electrical hazard), caused by the bias, of the photoconductor drum 5 which directly contacts the transfer roller 7 during the between-sheets time, becomes big and streaks are produced in an image. As shown in FIG. 4A, in the case where the between-sheets time X0 is a short period of time, the cleaning operation by the cleaning mode for the transfer roller 7 will not be performed. However, in the case where the between-sheets time X0 is a short period of time, the amount of toner which moves from the photoconductor drum 5 to the transfer roller 7 during the between-sheets time is small. Therefore, the small amount of toner adhered to the transfer roller 7 is removed by being moved and adhered to the subsequently conveyed recording medium P at an almost invisible level (self cleaning).

Also, in the present embodiment 1, in the case where the between-sheets time is a further long period of time, the driven member such as the photoconductor drum 5 and the developing device 42 is not continuously driven by the drive motor 15, and the driving is stopped as much as possible. Thus, a failure can be reliably alleviated in which the driven time of the driven member such as the photoconductor drum 5 and the developing device 42 is extended uselessly, shortening the service life of the driven member or a related member thereof. Furthermore, wasteful power consumption can be reduced.

Here, in the present embodiment 1, the time Y (=X−Z) as a cleaning mode performing time is set in such a way that the transfer roller 7 (transfer rotation body) can rotate at least once during the time Y. In this way, dirt of the whole circumference of the transfer roller 7 can be removed by applying the cleaning bias to the transfer roller 7 during the time of one or more rotations. However, because there is a case where the dirt of the transfer roller 7 cannot be completely removed during the time of one rotation, in the present embodiment 1, the cleaning bias corresponding to 3.9 rotations (the first cleaning bias of negative polarity for 3 rotations and the second cleaning bias of positive polarity for 0.9 rotations) is applied to the transfer roller 7.

The longer the cleaning bias application time (time Y) is, the better cleaning effect can be obtained. But the longer cleaning bias application time may lead to a situation where the cleaning mode is performed less frequently due to the determination based on the above formula, or more damage is applied to the photoconductor drum 5 as described above. Therefore, it is necessary to set an appropriate time for the cleaning bias applying time.

Also, referring to FIGS. 4A-4D, in the present embodiment 1, the cleaning mode is a mode in which, after a bias of an opposite polarity (negative) of the positive transfer bias as the first cleaning bias is applied to the transfer roller 7, another bias of the same polarity (positive) of the transfer bias as the second cleaning bias is applied to the transfer roller 7.

The above operations are needed because of the fact that the scumming toner adhered to the photoconductor drum 5 includes not only the normally charged scumming toner but also a small amount of reversely charged scumming toner, and moves and adheres to the transfer roller 7 during the between-sheets time. Then, regarding the normally charged (charged negative) toner adhered to the transfer roller 7, it can be returned to the photoconductor drum 5 by applying the first cleaning bias charged negative to the transfer roller 7. On the other hand, regarding the reversely charged (charged positive) toner adhered to the transfer roller 7, it can be returned to the photoconductor drum 5 by applying the second cleaning bias charged positive to the transfer roller 7. By performing the control described above, the toner adhered to the transfer roller 7 can be removed cleanly.

It should be noted that, referring to FIGS. 4A-4D, the cleaning bias is set in such a way that the absolute value thereof is less than the absolute value of the transfer bias (bias which is applied to a range corresponding to "recording medium/image area" in the figure).

With the above setting, the damage to the photoconductor drum 5 caused by the cleaning bias application can be made small.

Here, referring to FIGS. 4A-4D, in the case where the cleaning mode is performed during the between-sheets time based on the condition described above, the power supply unit 35 (bias applying unit) for the transfer roller is controlled in such a way that the cleaning mode is not started right after the beginning of the between-sheets time X, and that the cleaning mode is finished right before the end of the between-sheets time X. In other words, the power supply unit 35 is controlled in such a way that the cleaning mode is not performed in the first half of the between-sheets time, but is performed in the second half of the between-sheets time as much as possible.

The power supply unit 35 is controlled as described above because, in the case where the between-sheets time is a long period of time, there is a possibility that even if the cleaning mode is performed right after entering into the between-sheets time, the transfer roller 7 may end up getting dirty again before the end of the between-sheets time.

Specifically, time Q between the beginning of the between-sheets time and the start of the cleaning mode (cleaning mode performing timing) is, in the case where the drive OFF mode is not performed, calculated by a formula: Q=(between-sheets time X)−(cleaning mode performing time Y)−(margin R)=(non-image area bias applying time Z)−(margin R).

On the other hand, in the case where the drive OFF mode is performed, the cleaning mode performing timing Q is calculated by a formula:

$Q$=(timing when the drive motor is set ON again)−(cleaning mode performing time $Y$)−(margin $R$)=(bias application OFF time $Z$)−(margin $R$).

Also, time S between the beginning of the between-sheets time and the beginning of the drive OFF mode is calculated by a formula:

$S$=(between-sheets time $X$)−(drive OFF mode performing time $W$)−(margin $J$)−(cleaning mode performing time $Y$)−(margin $R$).

It should be noted that the margin R is a margin related to the cleaning mode and the margin J is a margin related to falling and rising of the drive. In other words, the time S between the beginning of the between-sheets time and the beginning of the drive OFF mode is defined by subtracting time required for falling and rising of the drive motor and marginal time related to time required for switching of the cleaning mode.

Also, in the above formulas, the margin R (ms) and the margin J (ms) may be a fixed value or may be a value where the between-sheets time X (variable) is multiplied by a predetermined coefficient.

By performing the control described above, the cleaning can be efficiently applied to the transfer roller 7 during the between-sheets time. It should be noted that, in the present embodiment, non-image area bias is also applied to the transfer roller 7 during the time corresponding to the margins R and S described above.

Also, referring to FIGS. 4A-4D, in the present embodiment 1, the power supply unit 35 for the transfer roller (bias applying unit) is controlled in such a way that during the time when the cleaning mode is not performed within the between-sheets time, the value of the transfer current flowing in the transfer roller 7 (non-image area bias) is 0 μA. Also, even when the cleaning mode is not performed, except for when the transfer process is performed (except for when the transfer bias is applied to the transfer roller 7), the power supply unit 35 is controlled in such a way that the value of the transfer current flowing in the transfer roller 7 is 0 μA.

The above control is performed because of the following reason. During the time other than the cleaning mode, if the transfer current (non-image area bias) is set high to the positive side, then the toner of the normal charge (negative charge) is excessively attracted to the transfer roller 7. Also, if the transfer current (non-image area bias) is set high to the negative side, then the toner of the reverse charge (positive charge) is excessively attracted to the transfer roller 7. Then, in the cased described above, there is a possibility that the longer the between-sheets time is, the more the dirt of the transfer roller 7 is accumulated. By applying the transfer current of 0 μA to the transfer roller 7 from right after the beginning of the between-sheets time, and, subsequently, applying a predetermined cleaning bias to the transfer roller 7, the dirt of the transfer roller 7 is efficiently removed and the back surface and the edge surface of the recording medium P are prevented from getting dirty with the toner.

It should be noted that in the present embodiment 1, referring to FIGS. 4A-4D, the cleaning bias (cleaning bias before the job) is also applied from the power supply unit 35 to the transfer roller 7 before the transfer process is performed for the recording medium P (before the job).

To describe in detail, the power supply unit 35 (bias applying unit) is controlled in such a way that right after the beginning of the image forming operation (print), during the time more than the time in which the transfer roller 7 rotates once, a bias whose absolute value is less than that of the transfer bias and whose polarity is opposite of the transfer bias (cleaning bias before job) is applied to the transfer roller 7.

With the control described above, even in the case where floating toner is adhered to the transfer roller 7 in a left-alone state before the beginning of the image forming operation, toner dirt of the transfer roller 7 can be removed before the transfer process.

Here, referring to FIG. 4D, in the present embodiment 1, as described above, the drive motor 15 is controlled in such a way that in the case where the time X (between-sheets time X3) exceeds the threshold value B, driving of the photoconductor drum 5 is stopped during the time Z (bias application OFF time) within the time X (between-sheets time X3). In other words, a time zone during which the cleaning mode is performed is controlled not to overlap with another time zone during which the drive OFF mode is performed and the driving of the photoconductor drum 5 is stopped.

The time zones are controlled as described above because the cleaning mode cannot play its role unless it is performed in a state where the photoconductor drum 5 is being rotated.

Here, as described above, the between-sheets time X during the continuous sheet passing (or the length of the between-sheets time) is a value varied by a control unit based on various conditions (predetermined conditions) in the image forming apparatus 1.

Also, in the present embodiment 1, the predetermined conditions include at least one of an operation condition of the post-processing device 50 which provides a post-process to the recording medium P after the image forming is performed by the image forming apparatus body 1, a temperature condition of the non-paper passing area N in the fixing device 20 which fixes the toner image on the recording medium P transferred at the transfer nip unit, and another temperature condition near the photoconductor drum 5 (image bearer).

To describe in detail, in the image forming apparatus 1 according to the present embodiment 1, similar to the conventional one, when a binding process, a folding process, or a punch process is performed for the plurality of the recording media P (sheet bundle) in the post-processing device 50, the time between one sheet bundle and another sheet bundle (between sheets, especially refer to between bundles) (between-bundles time) is set especially a long period of time. The above setting is performed in order to secure enough time for providing a post-process for the sheet bundle.

Figure 5:
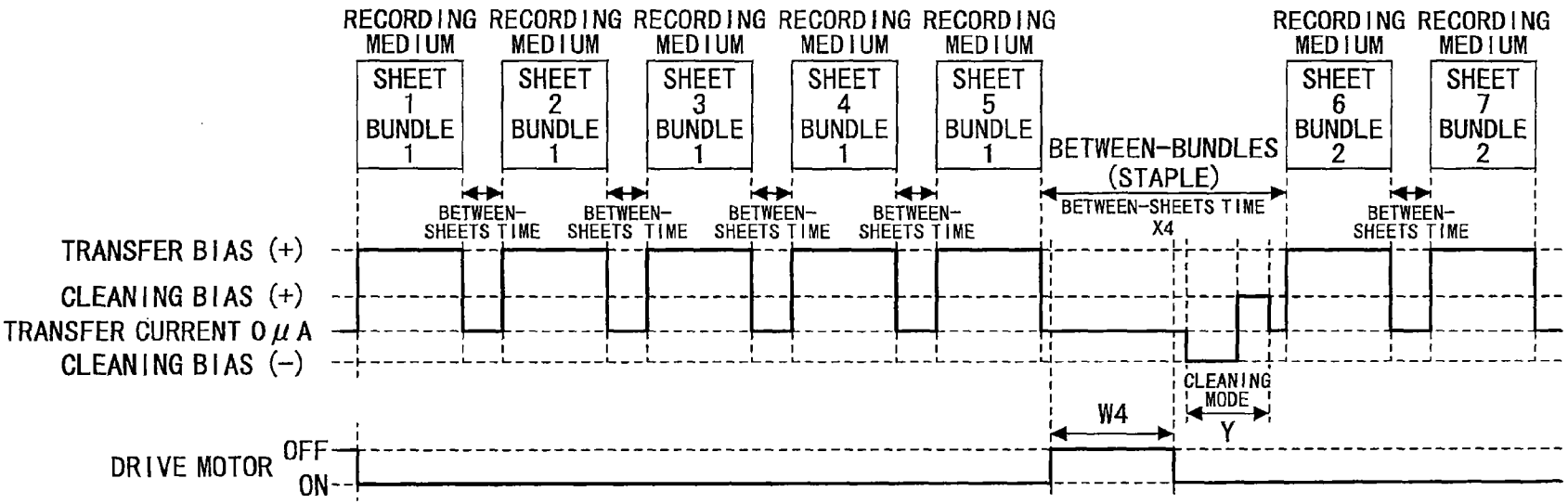
FIG. 5 is a timing chart illustrating an example of control of a power supply unit for a transfer roller and a drive motor when a post process is performed in the post-processing device.

FIG. 5 is a timing chart illustrating a current control of the power supply unit 35 for the transfer roller when a binding process (staple process) is provided for a bundle of the recording medium P by the post-processing device 50, the bundle of the recording medium P (a sheet bundle) including 5 sheets of the recording medium P. In a case like this, the between-sheets time X4 between one sheet bundle and another sheet bundle is set a very long (longer than the threshold value A) period of time and the cleaning mode is performed during the fixed time Y in the second half of the between-sheets time X4. Also, here, because the between-sheets time X4 is longer than the threshold value B, within the between-sheets time X4, in addition to the cleaning mode, the drive OFF mode is performed during the time W4.

Also, in the image forming apparatus 1 according to the present embodiment 1, as described above referring to FIG. 3, when an excess temperature rise is detected in the non-paper-passing area N due to the continuous sheet passing of small-size sheet, the between-sheets time is set a long period of time for a fixing temperature adjusting mode at the timing before the large-size sheet passes after the continuous sheet passing of small-size sheet. The above setting is performed in order to secure enough time for homogenizing the temperature distribution of the fixing member in the width direction before performing a fixing process for the large-size sheet.

Figure 6:
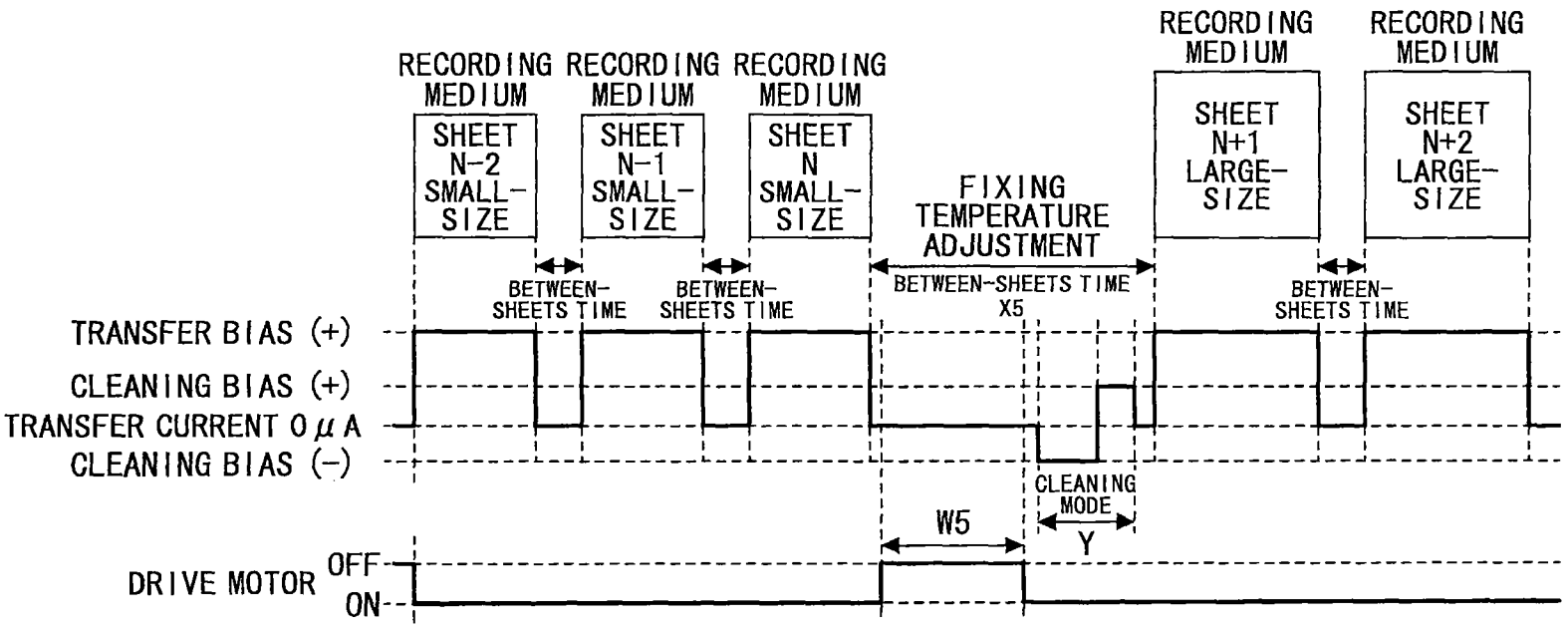
FIG. 6 is a timing chart illustrating an example of control of a power supply unit for a transfer roller and a drive motor when an excessive temperature rise of a non-paper-passing area occurs in the fixing device.

FIG. 6 is a timing chart illustrating current control of the power supply unit 35 for the transfer roller when an excessive temperature rise of non-paper-passing area occurs in the fixing device 20 as described above. In a case like this, when large-size sheet passes after the continuous sheet passing of small-size sheet, the between-sheets time X5 between the small-size sheet and the large-size sheet is set a very long (longer than the threshold value A) period of time and the cleaning mode is performed during the fixed time Y in the second half of the between-sheets time X5. Also, here, because the between-sheets time X5 is longer than the threshold value B, within the between-sheets time X5, in addition to the cleaning mode, the drive OFF mode is performed during time W5.

Also, in the image forming apparatus 1 according to the present embodiment 1, as shown in FIG. 1, a temperature and humidity sensor 48 as a temperature detection unit is arranged which detects temperature near the photoconductor drum 5. Also, when temperature equal to or greater than a predetermined value is detected by the temperature and humidity sensor, a "low productivity mode" is performed in which a temperature rise in the apparatus is suppressed by setting each between-sheets time X6 (see FIG. 7) a very long period of time. The above setting is performed because there is a possibility that the toner may melt and adhere to image formation parts when temperature in the apparatus (especially, temperature near the photoconductor drum 5) rises excessively. In particular, because low melting point toner is used in the present embodiment 1, this kind of problem cannot be ignored.

Figure 7:
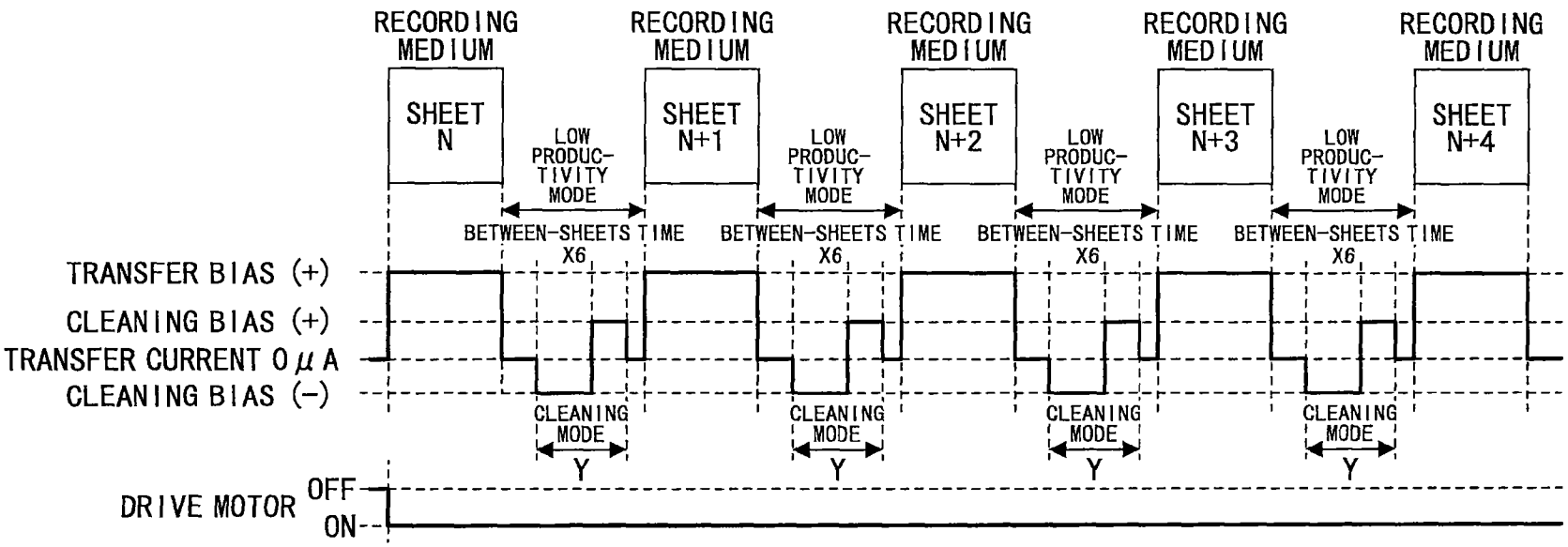
FIG. 7 is a timing chart illustrating an example of control of a power supply unit for a transfer roller and a drive motor when there is a rise in temperature near a photoconductor drum.

FIG. 7 is a timing chart illustrating current control of the power supply unit 35 for the transfer roller when there is a temperature rise near a photoconductor drum 5 as described above. In a case like this, each of the between-sheets times X6 between one sheet and another during the continuous sheet passing is set a very long (longer than the threshold value A) period of time and the cleaning mode is performed during the fixed time Y in the second half of the between-sheets time X6. Also, here, because the between-sheets time X6 is shorter than the threshold value B, within the between-sheets time X6, the cleaning mode is performed but the drive OFF mode is not performed.

It should be noted that the control like this, in which each of the between-sheets times X between one sheet and another during the continuous sheet passing is set a very long period of time, is control normally performed in a case where a thick sheet is used as the recording medium P, and the similar current control of the power supply unit 35 can be performed.

Also, the condition (predetermined condition) in which the between-sheets time X is set a long period of time during a continuous sheet passing is not limited to the above condition, but, for example, a condition where "two-sided print mode" is performed as described referring to FIG. 1 can be included.

Here, in the present embodiment 1, it is also possible to control the power supply unit 35 for the transfer roller (bias applying unit) in such a way that conveyance speed (almost equal to a value of process line speed which is a line speed of the photoconductor drum 5) of the recording medium P conveyed to the transfer nip unit is controlled to be variable and the cleaning bias is adjusted based on the conveyance speed (process line speed).

FIG. 8 is an example of such control illustrating different process line speeds and corresponding adjustment factors of the first cleaning bias and adjustment factors of the second cleaning bias when the process line speed can take three levels. In an example of FIG. 8, the process line speed in normal operation is 260 mm/s and the corresponding adjustment factors are 100. When the process line speed is reduced, the cleaning bias is reduced at a ratio corresponding to the adjustment factors shown in the figure. For example, compared to the first cleaning bias when the process line speed is 260 mm/s, the first cleaning bias when the process line speed is 150 mm/s is set to 83.

The above control is performed because an effective bias corresponding to a transfer current value changes as the process line speed (conveyance speed) changes. It is necessary to control the bias (current value) appropriately for different process line speeds. In other words, by performing the above control, the good and stable cleaning of the transfer roller 7 can be performed even when the process line speed (conveyance speed) varies. It should be noted that varying process line speed (conveyance speed) is used in a case where it is necessary to achieve good fixing quality and good luster quality with high accuracy even when paper thickness of the recording medium P is changed.

Also, in the present embodiment 1, using the above described temperature and humidity sensor 48 as an environment detection unit for detecting temperature and humidity, it is also possible to control the power supply unit 35 for the transfer roller (bias applying unit) in such a way that the cleaning bias is adjusted based on a detection result of the temperature and humidity sensor 48 (absolute humidity).

FIG. 9 is an example of such control illustrating the cleaning bias which varies based on the absolute humidity (the first cleaning bias and the second cleaning bias).

The above control is performed because the toner dirt of the transfer roller 7 receives strong influence from environment and there is a tendency that the higher the absolute humidity, the higher frequency the transfer roller 7 gets dirty. As a result, as shown in FIG. 9, when the absolute humidity is high, compared to when it is low, the absolute value of the cleaning bias output (transfer current value) is set high in order to provide stronger cleaning for the transfer roller 7.

In the following, referring to FIG. 10, an experiment conducted by the inventor of the present invention in order to see an effect related to the cleaning mode according to the present invention will be briefly described.

Figure 10:
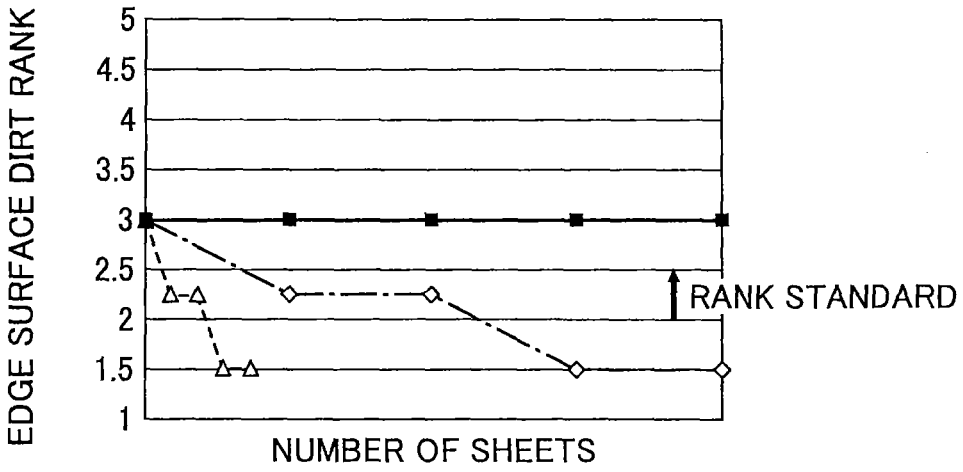
FIG. 10 is a graph illustrating experiment results regarding a rank change of edge surface dirt in accordance with a number of fed sheets.

FIG. 10 is a graph illustrating experiment results regarding a rank change of edge surface dirt of the recording medium according to the elapsed time. In FIG. 10, the horizontal axis indicates the number of passing sheets. Also, in FIG. 10, the vertical axis indicates a rank of the edge surface dirt. The rank is defined according to the level of the edge surface dirt in the recording medium P, rank 2 being an acceptable level, the level being improved as the rank number increases, and rank 5 being a level of no edge surface dirt. The experiment was conducted under a selected condition in which the dirt is most easily created in the image forming apparatus. The experiment was conducted under temperature and humidity environment of 27° C. 80%. Also, the transfer roller 7 which had reached the replacement service life was used and the print speed was set at 30 copies per minute (CPM). Also, in FIG. 10, a graph indicated by a dashed line is an experiment result under a condition in which the between-sheets time was relatively short (as short as in FIG. 4B) and the cleaning mode was not performed. A graph indicated by a dotted line is an experiment result under a condition in which the between-sheets time was relatively long (as long as in FIG. 5, or 10 s) and the cleaning mode was not performed. A graph indicated by a solid line is an experiment result under a condition in which the between-sheets time was relatively long (as long as in FIG. 5, or 10 s) and the cleaning mode was performed (condition in which the control according to the present embodiment 1 is performed).

From the result shown in FIG. 10, it can be seen that, by performing the control of the power supply unit 35 for the transfer roller according to the present embodiment 1, the transfer roller 7 is efficiently cleaned during the between-sheets time and the toner dirt of the recording medium P can certainly be reduced.

As described above, in the present embodiment 1, in the case where the between-sheets time X in the continuous sheet passing is a short period of time, the "cleaning mode" in which the cleaning bias is applied to the transfer roller 7 during the between-sheets time is not performed and "drive OFF mode" in which the driving of the driven member such as photoconductor drum 5 and/or the developing device 42 during the between-sheets time is stopped is not performed either. On the other hand, in the case where the between-sheets time X is of a medium length, during the between-sheets time X, the "cleaning mode" is performed but the "drive OFF mode" is not performed. Furthermore, in the case where the between-sheets time X is a long period of time, during the between-sheets time X, both the "cleaning mode" and the "drive OFF mode" are performed.

With the operations described above, without accelerating degradation of the photoconductor drum 5 due to the cleaning bias, and without lowering the productivity during the continuous sheet passing due to performing the cleaning mode, a problem is alleviated in which a back surface or an edge surface of a recording medium P conveyed to the transfer nip unit gets dirty due to the toner moved from the photoconductor drum 5 and adhering to the transfer roller 7, and even in a case where between-sheets time frequently becomes long, it is possible to make it difficult to happen that the service life of the photoconductor drum 5 and/or the developing device 42 is shortened.

Embodiment 2

Referring to FIGS. 11A-11D, embodiment 2 of the present invention will be described in detail.

FIGS. 11A-11D are timing charts illustrating control of the power supply unit 35 for the transfer roller and control of the drive motor performed in the image forming apparatus 1 according to the embodiment 2, which correspond to FIGS. 4A-4D for the embodiment 1.

The present embodiment 2 differs from the embodiment 1 in which the time Y for applying the cleaning bias is set to a fixed value, in that the time Y for applying the cleaning bias is a variable value (variable).

In the image forming apparatus 1 according to the present embodiment 2, similar to the above described embodiment 1, the power supply unit 35 for the transfer roller (bias applying unit) is also configured to apply a transfer bias, a cleaning bias, and a non-image area bias to the transfer roller 7 accordingly.

Also, in the image forming apparatus 1 according to the present embodiment 2, similar to the above described embodiment 1, when the photoconductor drum 5 (image bearer) is being driven and multiple sheets of the recording medium P are continuously conveyed, between-sheets time, which is defined by the time from when the recording medium P is ejected from the transfer nip unit to when the next recording medium P is conveyed to enter the transfer nip unit, and which is denoted as time X, is controlled to vary based on a predetermined condition. Also, in the case where the between-sheets time X does not exceed the threshold value A, none of the cleaning mode and the drive OFF mode is performed, in the case where the between-sheets time X exceeds the threshold value A but does not exceed the threshold value B, the drive OFF mode is not performed and the cleaning mode is performed, and in the case where the between-sheets time X exceeds the threshold value B, both the cleaning mode and the drive OFF mode are performed. Also, in the present embodiment 2, the power supply unit is controlled in such a way that the longer the time X (between-sheets time) is, the longer the time Z (non-image area bias applying time) is.

The above control is performed because if the applying time for the cleaning bias is controlled to be longer by the same amount as the time X (between-sheets time) is lengthened according to the predetermined condition, then the damage of the photoconductor drum 5 directly contacting the transfer roller 7 during the between-sheets time X caused by the bias becomes larger, creating an image with streaks. Also, the above control is performed in order to avoid wastefully driving the driven member such as the photoconductor drum 5 and/or the developing device 42 in the case where the between-sheets time is very long.

On the other hand, in the present embodiment 2, similar to the above embodiment 1, the time Z (non-image area bias applying time) becomes longer as the time X (between-sheets time) becomes longer so that the time for applying the cleaning bias (X−Z) does not become too long even when the time X becomes longer, thus, the damage of the photoconductor drum 5 can be made small. Also, reduced service life of the related members can be alleviated because driving the driven member such as the photoconductor drum 5 and/or the developing device 42 is stopped in the case where the between-sheets time is very long.

Figure 11A:
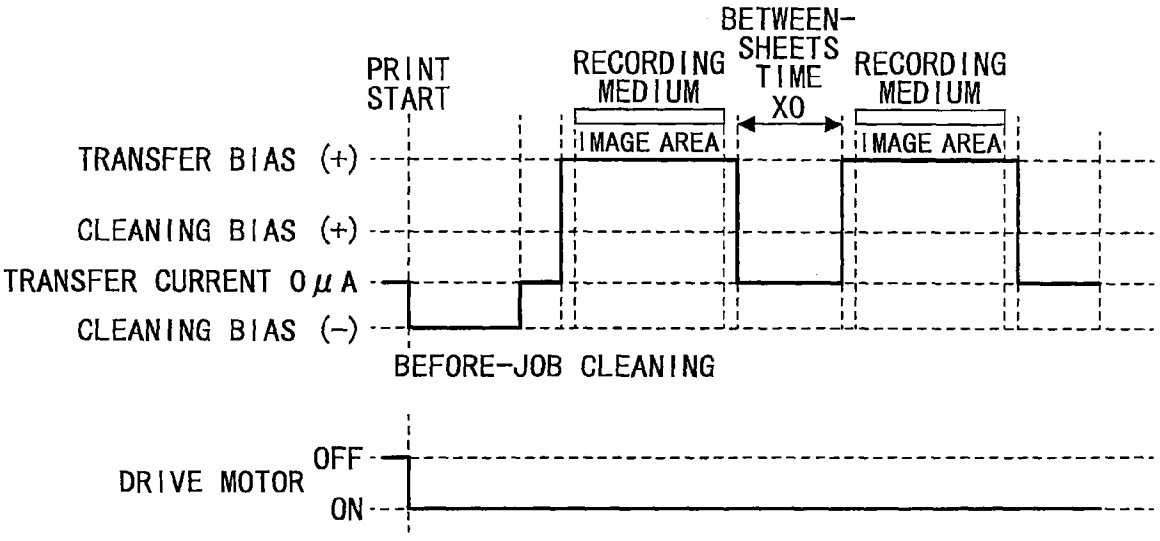
FIGS. 11A-11D are timing charts illustrating control of a power supply unit for a transfer roller and a drive motor which is performed in an image forming apparatus according to a second embodiment of the present invention.
Figure 11B:
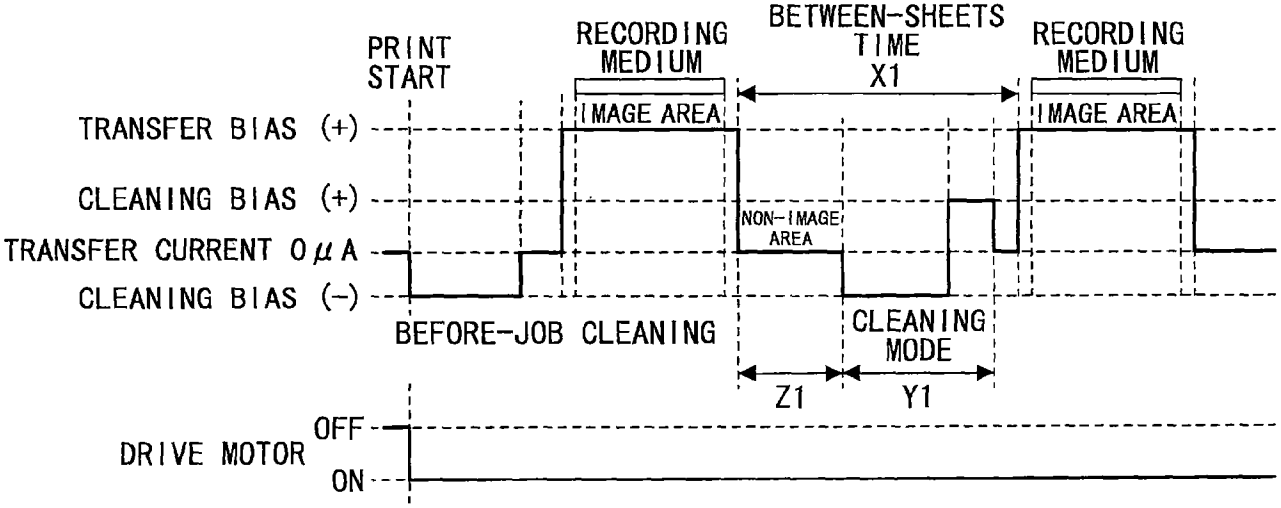
Figure 11C:
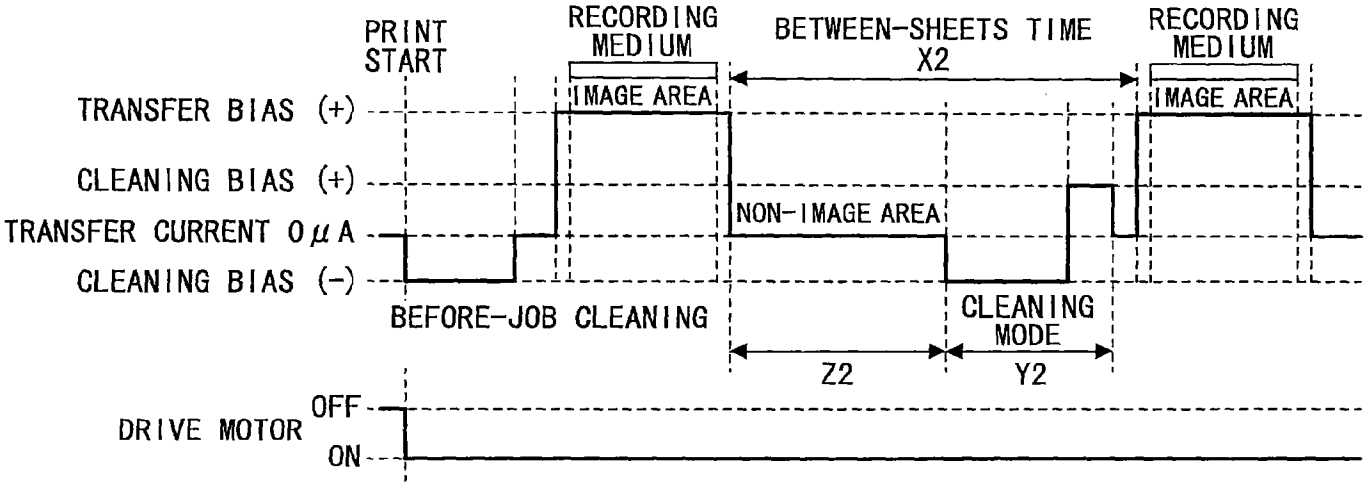
Figure 11D:
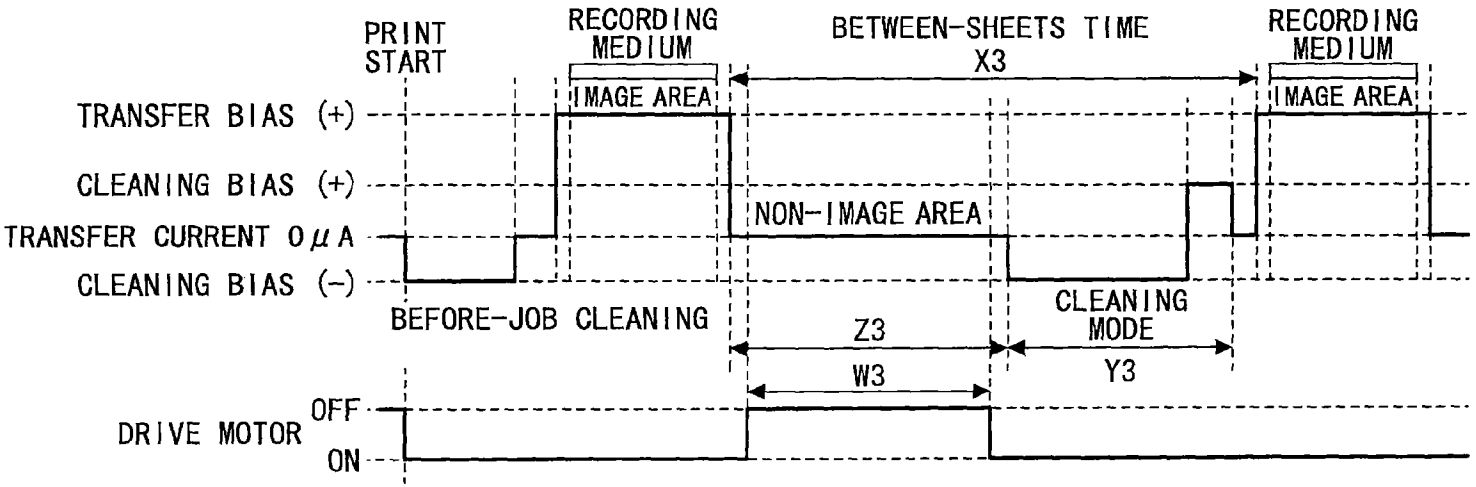

Here, referring to FIGS. 11B-11D, in the present embodiment 2, different from the above embodiment 1, the time Y for applying the cleaning bias is controlled to be variable according to the between-sheets time X. To describe in detail, in the case where the cleaning mode is performed, as the between-sheets time becomes longer X1, X2, and X3 in this order, the cleaning mode performing time becomes longer little-by-little Y1, Y2, and Y3 in this order. In this way, by fine-tuning the cleaning mode performing time Y in accordance with the length of the between-sheets time X, a better cleaning performance can be obtained.

Further specifically, when a minimum value Y0 (ms) is defined as minimum time required for performing the "cleaning mode" in which the cleaning bias is applied to the transfer roller 7, in the case where a value in which the minimum value Y0 is subtracted from the variable X which varies according to the predetermined condition (X−Y0) exceeds a predefined threshold value α' (X−Y0>α'), the cleaning mode is controlled to be performed during the between-sheets time X. In other words, the cleaning mode is performed in the case where the between-sheets time X exceeds the threshold value A (=Y0+threshold value α').

Also, as shown in FIG. 11B, when the sheet passing is performed during between-sheets time X1 (>Y0+α'(=A)) where the relation (between-sheets time X)−(minimum value Y0)>(threshold value α') is satisfied, the cleaning mode is performed during the time Y1 within the between-sheets time X1. Also, as shown in FIG. 11C, when the sheet passing is performed during between-sheets time X2 (>X1>Y0+α'(=A)) where the relation of the above formula is satisfied, the cleaning mode is performed during the time Y2 (>Y1) within the between-sheets time X2. Furthermore, as shown in FIG. 11D, when the sheet passing is performed during between-sheets time X3 (>X2>Y0+α'(=A)) where the relation of the above formula is satisfied, the cleaning mode is performed during the time Y3 (>Y2) within the between-sheets time X3.

On the other hand, as shown in FIG. 11A, when the sheet passing is performed during between-sheets time X0 (≤Y0+α'(=A)) where the relation of the above formula is not satisfied, the cleaning mode is not performed during the between-sheets time X0.

Also, as shown in FIG. 11D, only in the case where the between-sheets time X3 exceeds the threshold value B, the drive OFF mode is performed during the time W3 within the between-sheets time X3.

As described above, in the case where the cleaning bias applying time Y is increased as much as the between-sheets time X is increased, for example, the time Z is fixed, and Y2 is defined by Y2=Y1+(X2−X1), when the between-sheets time X (X2) is very long, the cleaning bias applying time Y (Y2) also becomes very long, thus, the damage of the photoconductor drum 5 due to the bias becomes big in accordance with Y2.

On the other hand, in the present embodiment 2, the non-image area bias applying time Z is set long as much as the between-sheets time X becomes long. In other words, as shown in FIGS. 11B-11D, the non-image area bias applying time Z (Z1−Z3) becomes long as the between-sheets time X (X1−X3) becomes long (X3>X2>X1, Z3>Z2>Z1). As a result, even when the between-sheets time X is long, the cleaning bias applying time Y does not become too long; thus, the damage of the photoconductor drum 5 can be made small while good cleaning performance is maintained.

It should be noted that the above minimum value Y0 is set in such a way that the transfer roller 7 (transfer rotation body) rotates as least once during Y0. Also, the times Y1, Y2, and Y3 corresponding to the variable between-sheets times X1, X2, and X3 are set to be equal to or greater than the minimum value Y0. In this way, dirt of the whole circumference of the transfer roller 7 can be removed by applying the cleaning bias to the transfer roller 7 during the time of one or more rotations.

As described above, in the present embodiment 2, similar to the above embodiment 1, in the case where the between-sheets time X in the continuous sheet passing is a short period of time, the "cleaning mode" in which the cleaning bias is applied to the transfer roller 7 during the between-sheets time is not performed and "drive OFF mode" in which the driving of the driven member such as photoconductor drum 5 and/or the developing device 42 during the between-sheets time is stopped is not performed either. On the other hand, in the case where the between-sheets time X is of a medium length, during the between-sheets time, the "cleaning mode" is performed but the "drive OFF mode" is not performed. Furthermore, in the case where the between-sheets time X is a long period of time, during the between-sheets time, both the "cleaning mode" and the "drive OFF mode" are performed.

With the operations described above, without accelerating degradation of the photoconductor drum 5 due to the cleaning bias, and without lowering the productivity during the continuous sheet passing due to performing the cleaning mode, a problem is alleviated in which a back surface or an edge surface of a recording medium P conveyed to the transfer nip unit gets dirty due to the toner moved from the photoconductor drum 5 and adhering to the transfer roller 7; and even in a case where between-sheets time frequently becomes long, it is possible to make it difficult to happen that the service life of the photoconductor drum 5 and/or the developing device 42 is shortened.

Embodiment 3

Embodiment 3 of the present invention will be described in detail referring to FIGS. 12-16.

Figure 12:
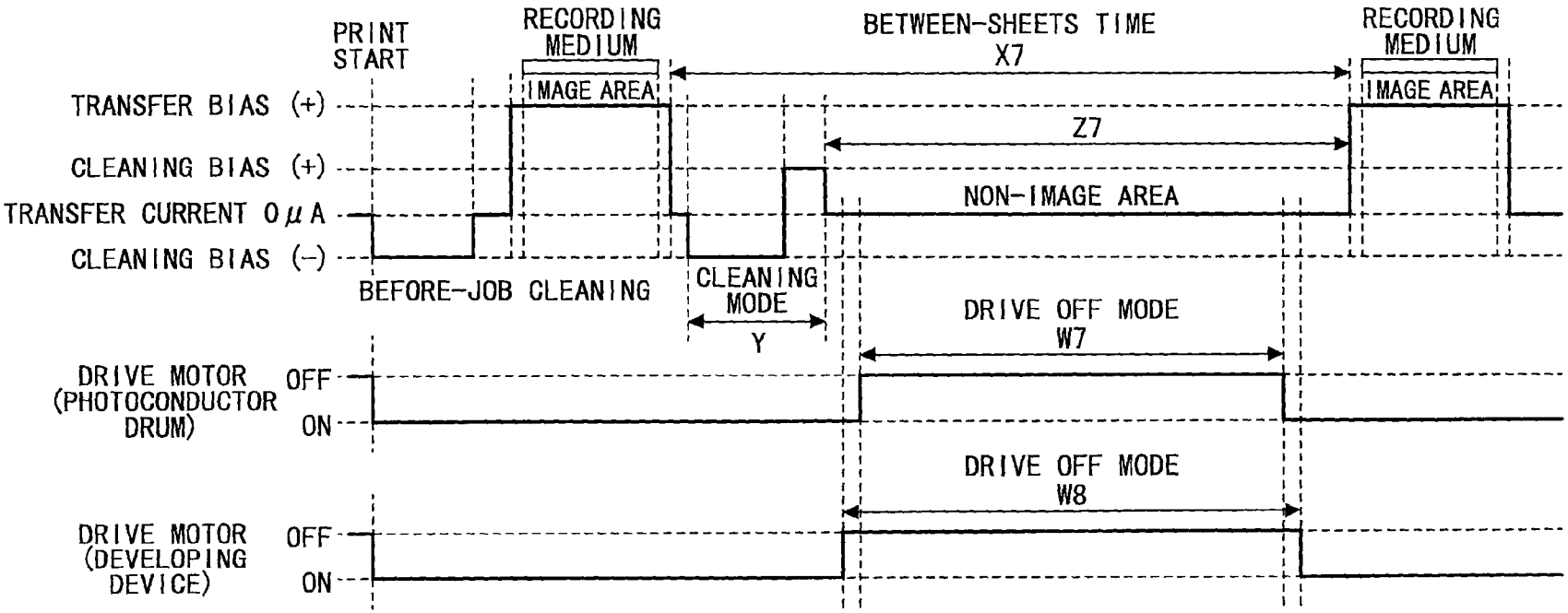
FIG. 12 is a timing chart illustrating control of a power supply unit for a transfer roller and a drive motor which is performed in an image forming apparatus according to an embodiment 3 of the present invention.

FIG. 12 is a timing chart illustrating control of the power supply unit 35 for the transfer roller and control of the drive motor performed in the image forming apparatus 1 according to the embodiment 3, which corresponds to FIG. 4D for the above embodiment 1. Also, FIGS. 13-16 are timing charts illustrating control of the power supply unit 35 for the transfer roller and control of the drive motor, which are modified examples of FIG. 12.

The present embodiment 3 differs from the above embodiment 1 in which the cleaning OFF mode is performed right before the between-sheets time is finished, in that the cleaning mode is performed right after the beginning of the between-sheets time in the case where the cleaning mode and the drive OFF mode of the photoconductor drum 5 are performed.

Also, in the image forming apparatus 1 according to the present embodiment 3, similar to the above described embodiments, in the case where the between-sheets time X during the continuous sheet passing does not exceed the threshold value A, none of the cleaning mode and the drive OFF mode is performed. On the other hand, in the case where the between-sheets time X exceeds the threshold value A but does not exceed the threshold value B, during the between-sheets time X, the cleaning mode is performed but the drive OFF mode is not performed. Furthermore, in the case where the between-sheets time X exceeds the threshold value B, during the between-sheets time X, both the cleaning mode and the drive OFF mode are performed.

Also, in the present embodiment 3, the photoconductor drum 5 and the developing device 42 are used as driven members which are targets of the drive OFF mode. Here, in the present embodiment 3, different from the above embodiments, the photoconductor drum 5 and the developing device 42 are driven independently by corresponding drive motors. In other words, apart from the drive motor (drive unit) for the photoconductor drum 5, the drive motor (drive unit) for the developing device 42 is arranged.

Also, as shown in FIG. 12, in the case where the between-sheets time X7 exceeds the threshold value B, drive OFF mode performing time W8 of the developing device 42 is controlled to be slightly longer than drive OFF mode performing time W7 of the photoconductor drum 5. Specifically, the drive OFF mode of the photoconductor drum 5 is controlled to start after the drive OFF mode of the developing device 42 starts, and the drive OFF mode of the developing device 42 is controlled to end after the drive OFF mode of the photoconductor drum 5 ends.

As described above, while it is necessary to control the drive OFF mode of the photoconductor drum 5 not to overlap with the cleaning mode, the drive OFF mode of the developing device 42 does not influence cleaning performance of the cleaning mode. Therefore, by controlling the drive OFF mode performing time X8 of the developing device 42 to be longer, a failure can be further reliably alleviated in which the service life of the developing device 42 is shortened.

In this way, in the case where the between-sheets time X is long, by not performing the wasteful driving of the developing device 42, not only the shortening of mechanical service life of the developing device 42 and the related members (lifetime of a developing roller, a conveyance screw, a bearing, a gear, etc., related to wear degradation), but also the shortening of service life of developer contained in the developing device 42 (lifetime related to toner degradation, carrier degradation, toner adhesion, etc.) can be alleviated.

Also, in the case where the between-sheets time X is long, by not performing the wasteful driving of the photoconductor drum 5, the shortening of mechanical service life of the photoconductor drum 5 and the related members (service life related to wear degradation of a gear or a bearing, surface degradation of the photoconductor drum, wear degradation of a cleaning blade, wear degradation of a charging roller, and the like) can be alleviated.

Here, as shown in FIG. 12, in the image forming apparatus 1 according to the present embodiment 3, different from the above embodiments, in the case where the between-sheets time X7 exceeds the threshold value B, and where the cleaning mode and the drive OFF mode of the photoconductor drum 5 are performed, the cleaning mode is controlled to be performed before the drive OFF mode of the photoconductor drum 5 is performed, and the cleaning mode is controlled to be performed right after the beginning of the between-sheets time.

The above described control can be performed because, in a state where the driving of the photoconductor drum 5 is stopped (rotation stop), a phenomenon rarely occurs in which the transfer roller 7 gets dirt from the scumming toner on the photoconductor drum 5. Also, by performing the cleaning of the transfer roller 7 before the driving of the photoconductor drum 5 is stopped, a failure can be prevented in which the transfer roller 7, whose surface is contaminated with the toner, abuts the driving-stopped photoconductor drum 5 for a long time and the toner is fixed to the surface of the photoconductor drum 5.

Also, in the present embodiment 3, in the case where the between-sheets time X exceeds the threshold value B, when, right before the between-sheets time X ends, the driving of the driven member such as the photoconductor drum 5 is restarted from a driving-stopped state, the timing of the driving restart is determined by, calculating back from the timing of the end of the between-sheets time X, subtracting the time required for turning ON the drive unit and a predetermined margin. In other words, in the case where the drive OFF mode is performed before the between-sheets time ends as in the present embodiment 3, the timing when the drive motor is turned ON after the drive OFF mode is released (turning-ON-operation performing timing) can be determined by, calculating back from the timing when the printing is restarted after the between-sheets time is over, further subtracting the time required for turning ON the drive motor (turning ON operation time) and the predetermined margin. In other words, the timing is controlled in such a way that a relation (turning-ON-operation performing timing)=(print job restart timing)−(turning ON operation time)−(margin) is satisfied.

Here, the "margin" is a value determined in order to, without lowering the productivity during the continuous sheet passing, let the turning ON operation for the drive motor be finished as close as possible to the timing right before the restart of the print job. If the margin is set to a large value, then the time during which the photoconductor drum 5 and the developing device 42 are wastefully driven becomes long. If the margin is set to a small value, then the print job restart is delayed and the productivity during the continuous sheet passing is lowered.

It should be noted that, not shown in the figure, in the present embodiment 3, similar to the above embodiments, in the case where the between-sheets time X exceeds the threshold value A and does not exceed the threshold value B and only the cleaning mode is performed, the cleaning mode is not performed right after the beginning of the between-sheets time but performed right before the end of the between-sheets time.

In other words, in the case where the between-sheets time X exceeds the threshold value A and does not exceed the threshold value B, the power supply unit 35 for the transfer roller (bias applying unit) is controlled not to start applying the cleaning bias right after the beginning of the between-sheets time, but to finish applying the cleaning bias right before the end of the between-sheets time. Also, in the case where the between-sheets time X exceeds the threshold value B, the power supply unit 35 for the transfer roller (bias applying unit) is controlled to start and finish applying the cleaning bias before the driving of the photoconductor drum 5 is stopped by the drive motor (drive unit).

Figure 13:
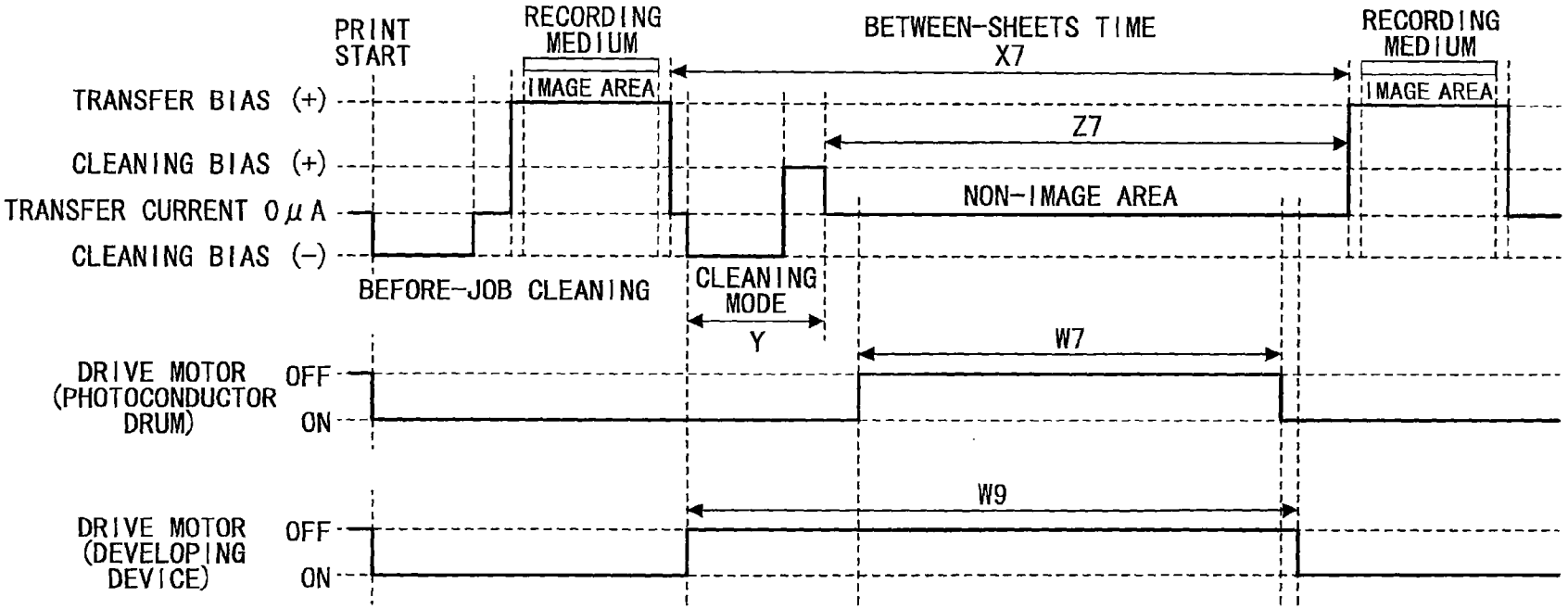
FIG. 13 is a timing chart illustrating control of a power supply unit for a transfer roller and a drive motor as a modified example 1.

A timing chart shown in FIG. 13 is a modified example 1 corresponding to the present embodiment 3 illustrated in FIG. 12.

Referring to FIG. 13, in the modified example 1, in the case where the between-sheets time X7 exceeds the threshold value B, the drive motor (drive unit) for the developing device 42 is controlled to stop driving the developing device within the range of the between-sheets time X7. Specifically, the drive OFF mode of the developing device 42 is performed during the time W9, starting from almost the same timing as the cleaning mode right after the beginning of the between-sheets time X7, ending after the end of the drive OFF mode of the photoconductor drum 5 and right before the end of the between-sheets time X7.

The above described control can be performed because, as described above, the drive OFF mode of the developing device 42 has no influence on the performance of the cleaning mode. Also, by taking the drive OFF mode performing time X9 as much as possible within the range of the between-sheets time X7, a benefit of alleviating a failure in which the service life of the developing device 42 is shortened can surely be obtained.

However, in the case where the developing roller of the developing device 42 abuts the surface of the photoconductor drum 5 (for example, in the case where a developing device of a contact-type one-component developing system is used), and where, by driving the photoconductor drum 5 in a state where the driving of the developing device 42 is stopped, both the developing roller and the photoconductor drum 5 wear out due to sliding contact, it is preferable that the timing of the drive OFF mode of the photoconductor drum 5 be consistent with the timing of the drive OFF mode of the developing device 42. In other words, as shown in FIG. 12, in the case where the between-sheets time X exceeds the threshold value B, it is preferable to control the drive motor (drive unit) in such a way that the timing of driving and stopping of the developing device 42 is made almost the same as the timing of driving and stopping of the photoconductor drum 5 (image bearer) during the between-sheets time X.

Figure 14:
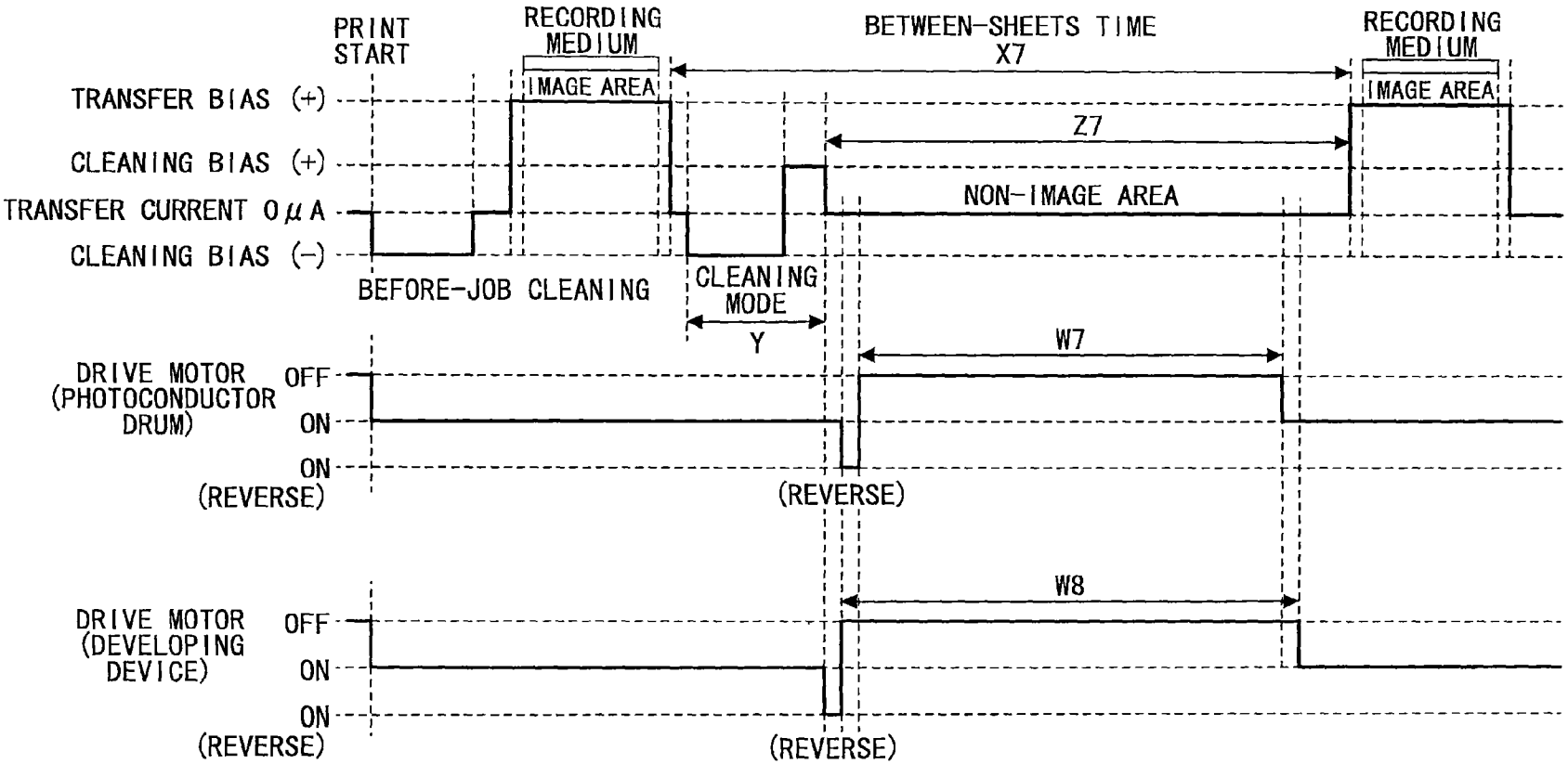
FIG. 14 is a timing chart illustrating control of a power supply unit for a transfer roller and a drive motor as a modified example 2.

A timing chart shown in FIG. 14 is a modified example 2 corresponding to the present embodiment 3 illustrated in FIG. 12.

In the modified example 2, the drive unit is capable of driving the driven member in a reverse direction with respect to the drive direction during the image forming operation. Also, in the case where the between-sheets time X exceeds the threshold value B, the drive unit is controlled in such a way that the driven member is driven in the reverse direction right before the driving of the driven member is stopped during the time W.

Specifically, both the drive motor for the photoconductor drum 5 and the drive motor for the developing device 42 are front-and-reverse-direction-rotation type drive motors. Also, referring to FIG. 14, the drive motor is controlled in such a way that, right before the beginning of the drive OFF mode of the photoconductor drum 5 (right before the rotation of the photoconductor drum 5 is stopped), the photoconductor drum 5 is rotated in the reverse direction for a short period of time (as long as 3 to 4 mm in terms of the travel distance). Similarly, the drive motor is controlled in such a way that, right before the beginning of the drive OFF mode of developing device 42 (right before the rotation of the developing device 42 is stopped), the developing device 42 is rotated in the reverse direction for a short period of time (as long as 3 to 4 mm in terms of the travel distance of the developing roller surface).

By performing the control described above, because it becomes easy that foreign matter such as non-transferred toner or paper dust accumulated at the edge of the cleaning blade of the cleaning device 43 abutting the surface of the photoconductor drum 5 is removed by being moved along the reverse rotating photoconductor drum 5, a problem can be alleviated in which the toner is fixed to the edge of the cleaning blade, or the paper dust is clogged at the edge. Also, because it becomes easy that the developer having penetrated in between the developing roller and the doctor blade in the developing device 42 (doctor gap) is removed by being moved along the reverse-rotating developing roller, a problem can be alleviated in which the toner (developer) is fixed to the tip of the doctor blade.

It should be noted that because the above problem of the developing device 42 occurs less frequently compared to the above problem of the photoconductor drum 5, the above described driving in the reverse direction of the developing device 42 may not be performed every time the drive OFF mode of the S developing device 42 is performed and may be performed after every predetermined number of times the drive OFF mode of the developing device 42 is performed.

Figure 15:
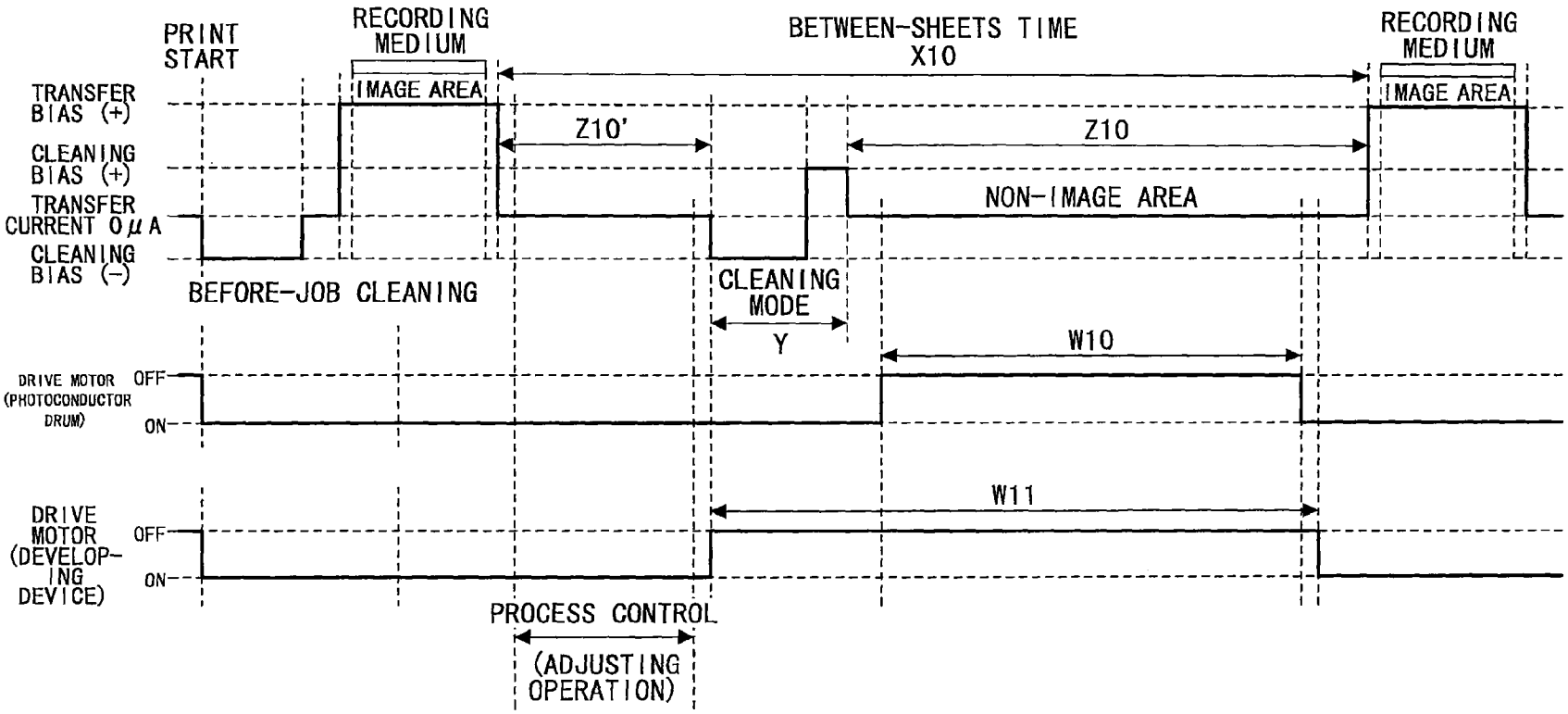
FIG. 15 is a timing chart illustrating control of a power supply unit for a transfer roller and a drive motor as a modified example 3.

A timing chart shown in FIG. 15 is a modified example 3 corresponding to the present embodiment 3 illustrated in FIG. 12.

Referring to FIG. 15, in the modified example 3, in the case where the between-sheets time X10 exceeds a threshold value C which is greater than the threshold value B, at the timing before the power supply unit 35 for the transfer roller (bias applying unit) is controlled to apply the cleaning bias, a process control (image formation adjustment) as an adjustment operation related to image forming operation is performed.

To describe in detail, the threshold value C is a value set for securing, in addition to the time Y for performing the cleaning mode and the time W10 for performing the drive OFF mode of the photoconductor drum 5, time Z' for performing the predefined process control (adjustment operation). Also, in the case where the between-sheets time X10 exceeds the threshold value C, after the beginning of the between-sheets time X10 and before the beginning of the cleaning mode, the process control (adjustment operation) is performed in a state where the photoconductor drum 5 and the developing device 42 are being driven (before the earliest performed drive OFF mode is started). A known method can be used for the process control itself. Here, a charge bias which is applied to a charging roller 41 is adjusted based on a non-image area potential (charge potential) on the photoconductor drum 5 detected by a surface electrometer 46 shown in FIG. 1, an exposure amount at the exposure unit 3 is adjusted based on the image area potential (exposure potential) on the photoconductor drum 5 detected by the surface electrometer 46, and a developing bias which is applied to the developing roller (developer bearer) of the developing device 42 is adjusted based on image density of a patch pattern (a toner image of a substantially rectangular shape, which is formed for image density adjustment apart from the normal toner image) detected by an image density detection sensor 47 shown in FIG. 1.

By performing the control described above, in the case where the between-sheets time X10 becomes a very long period of time, such time is not wasted but used for performing adjustment related to image forming operations. As a result, not only high quality and stable image forming become available, but also the time a user has to wait can be reduced.

It should be noted that in an example of FIG. 15, the power supply unit 35 is controlled in such a way that, during the time Z10' when the process control (adjustment operation) is performed, non-image area bias is applied to the transfer roller 7 so that the patch pattern of the image density adjustment is not adhered to the transfer roller 7. On the other hand, in the case where a moving-apart unit configured to move the transfer roller 7 apart from the photoconductor drum 5 is arranged, it is possible to control the moving-apart unit in such a way that when the process control (adjustment operation) is performed, the transfer roller 7 is moved apart from the photoconductor drum 5 so that the patch pattern of the image density adjustment is not adhered to the transfer roller 7.

Also, in an example of FIG. 15, process control is performed as an adjustment operation related to an image forming operation during the between-sheets time. However, the adjustment operation related to image forming operation during the between-sheets time is not limited to it, but, for example, in the case where the developer (carrier) contained in the developing device 42 is operated to be automatically replaced, such an operation may be performed as an adjustment operation. Also, in the case where an intermediate transfer belt on which a toner image of multiple colors repeatedly is borne (refer to FIGS. 19A-19B described later) is arranged, an operation for adjusting position misalignment of the toner image of the multiple colors which is transferred as a first order transfer onto the intermediate transfer belt may be performed as an adjustment operation.

Figure 16:
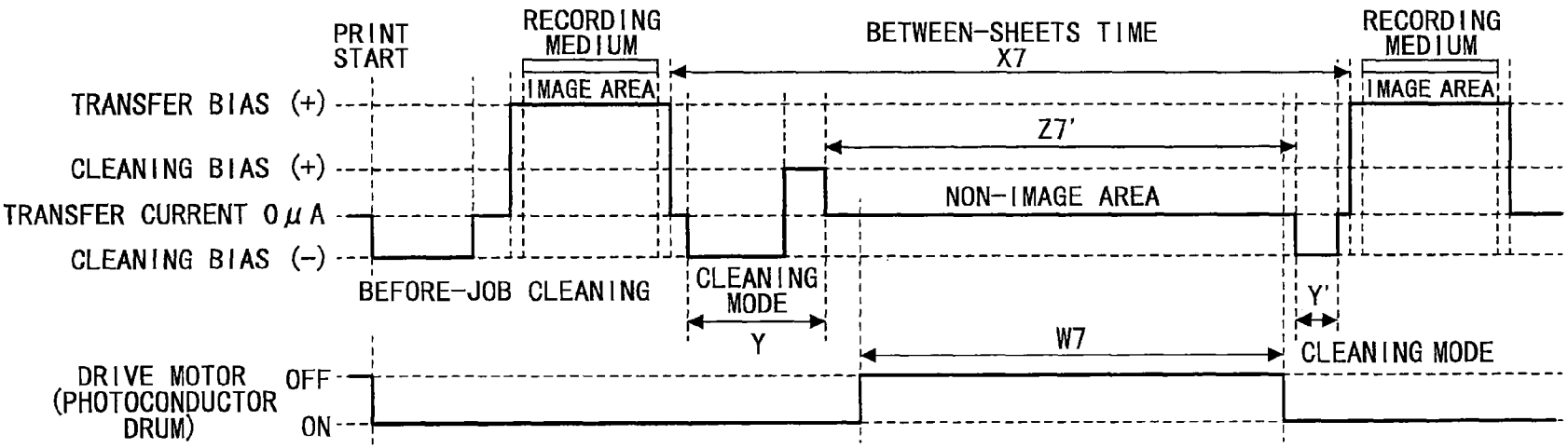
FIG. 16 is a timing chart illustrating control of a power supply unit for a transfer roller and a drive motor as a modified example 4.

A timing chart shown in FIG. 16 is a modified example 4 corresponding to the present embodiment 3 illustrated in FIG. 12.

Referring to FIG. 16, in the modified example 4, within the between-sheets time X7, the cleaning mode is controlled to be performed before and after the time W7 when the drive OFF mode of the photoconductor drum 5 is performed. Specifically, the first cleaning mode is performed during the time Y right after the beginning of the between-sheets time X7 (the second cleaning bias is applied after the first cleaning bias is applied), then, the drive OFF mode of the photoconductor drum 5 is performed, and then, the second cleaning mode is performed during the time Y' right before the end of the between-sheets time X7 (only the first cleaning bias is applied). In the above case, a summation of the first cleaning mode performing time Y and the second cleaning mode performing time Y' is the performing time of the cleaning mode performed during the between-sheets time X7.

The role of the cleaning mode can also be achieved even in the case where the above control is performed. In particular, the above control is useful in the case where the cleaning mode performing time can be set relatively long.

As described above, in the present embodiment 3, similar to the above embodiments, in the case where the between-sheets time X in the continuous sheet passing is a short period of time, the "cleaning mode" in which the cleaning bias is applied to the transfer roller 7 during the between-sheets time X is not performed and "drive OFF mode" in which the driving of the driven member such as photoconductor drum 5 and the developing device 42 during the between-sheets time X is stopped is not performed either. On the other hand, in the case where the between-sheets time X is of a medium length, during the between-sheets time X, the "cleaning mode" is performed but the "drive OFF mode" is not performed. Furthermore, in the case where the between-sheets time X is a long period of time, during the between-sheets time X, both the "cleaning mode" and the "drive OFF mode" are performed.

With the operations described above, without accelerating degradation of the photoconductor drum 5 due to the cleaning bias, and without lowering the productivity during the continuous sheet passing due to performing the cleaning mode, a problem is alleviated in which a back surface or an edge surface of a recording medium P conveyed to the transfer nip unit gets dirty due to the toner moved from the photoconductor drum 5 and adhering to the transfer roller 7, and even in a case where between-sheets time frequently becomes long, it is possible to make it difficult to happen that the service life of the photoconductor drum 5 and the developing device 42 is shortened.

Embodiment 4

Referring to FIG. 17, embodiment 4 of the present invention will be described in detail.

FIGS. 17A-17D are timing charts illustrating control of the power supply unit 35 for the transfer roller and control of the drive motor performed in the image forming apparatus 1 according to the embodiment 4, which correspond to FIGS. 4A-4D for the embodiment 1. Also, FIGS. 18A-18B are modified examples, and FIG. 18A and FIG. 18B correspond to FIG. 17B and FIG. 17C, respectively.

The present embodiment 4 differs from the above embodiments in that "low speed drive mode" is performed in which the drive motor 15 is driven with a speed slower than the normal speed according to the length of the between-sheets time X.

In the image forming apparatus 1 according to the present embodiment 4, similar to the above described embodiments, the power supply unit 35 for the transfer roller (bias applying unit) is also controlled to apply a transfer bias, a cleaning bias, and a non-image area bias to the transfer roller 7 accordingly.

Also, in the image forming apparatus 1 according to the present embodiment 4, similar to the above described embodiments, when the photoconductor drum 5 (image bearer) is being driven and multiple sheets of the recording medium P are continuously conveyed, between-sheets time, which is defined by the time from when the recording medium P is ejected from the transfer nip unit to when the next recording medium P is conveyed to enter the transfer nip unit, and which is denoted as time X, is controlled to vary based on a predetermined condition. Also, in the case where the between-sheets time X does not exceed the threshold value A, none of the cleaning mode and the drive OFF mode is performed, in the case where the between-sheets time X exceeds the threshold value A but does not exceed the threshold value B, the drive OFF mode is not performed but the cleaning mode is performed, and in the case where the between-sheets time X exceeds the threshold value B, both the cleaning mode and the drive OFF mode are performed. Also, in the present embodiment 4, the power supply unit is controlled in such a way that the longer the time X (between-sheets time) is, the longer the time Z (non-image area bias applying time) is.

Also, in the present embodiment 4, similar to the embodiment 1, the time Y for applying the cleaning bias (time for performing the cleaning mode) is fixed. It should be noted that, on the contrary, in the present embodiment 4, similar to the embodiment 2, it is possible to make the time Y for applying the cleaning bias (time for performing the cleaning mode) variable according to the between-sheets time X.

Figure 17A:
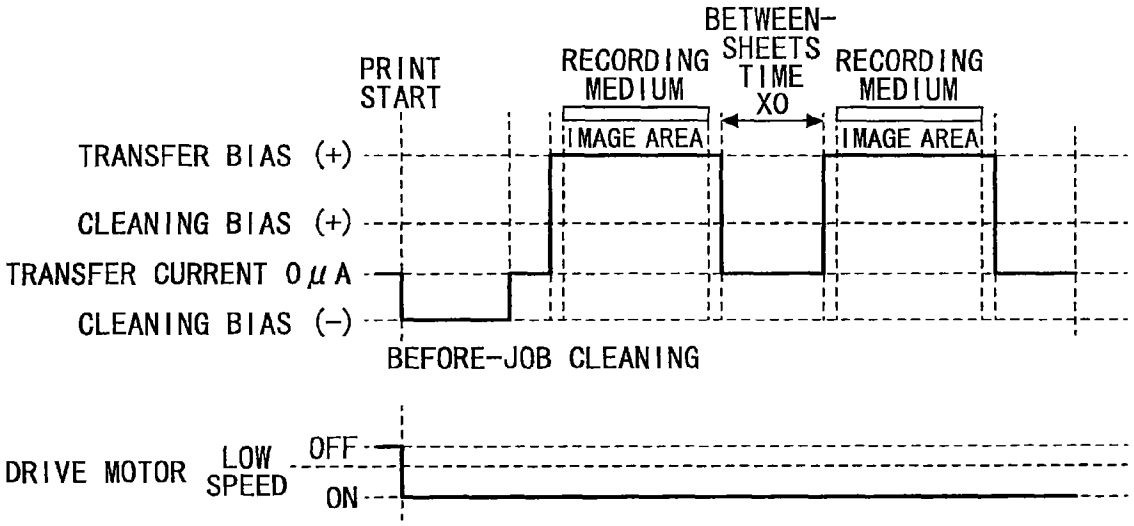
FIGS. 17A-17D are timing charts illustrating control of a power supply unit for a transfer roller and a drive motor which is performed in an image forming apparatus according to an embodiment 4 of the present invention.
Figure 18A:
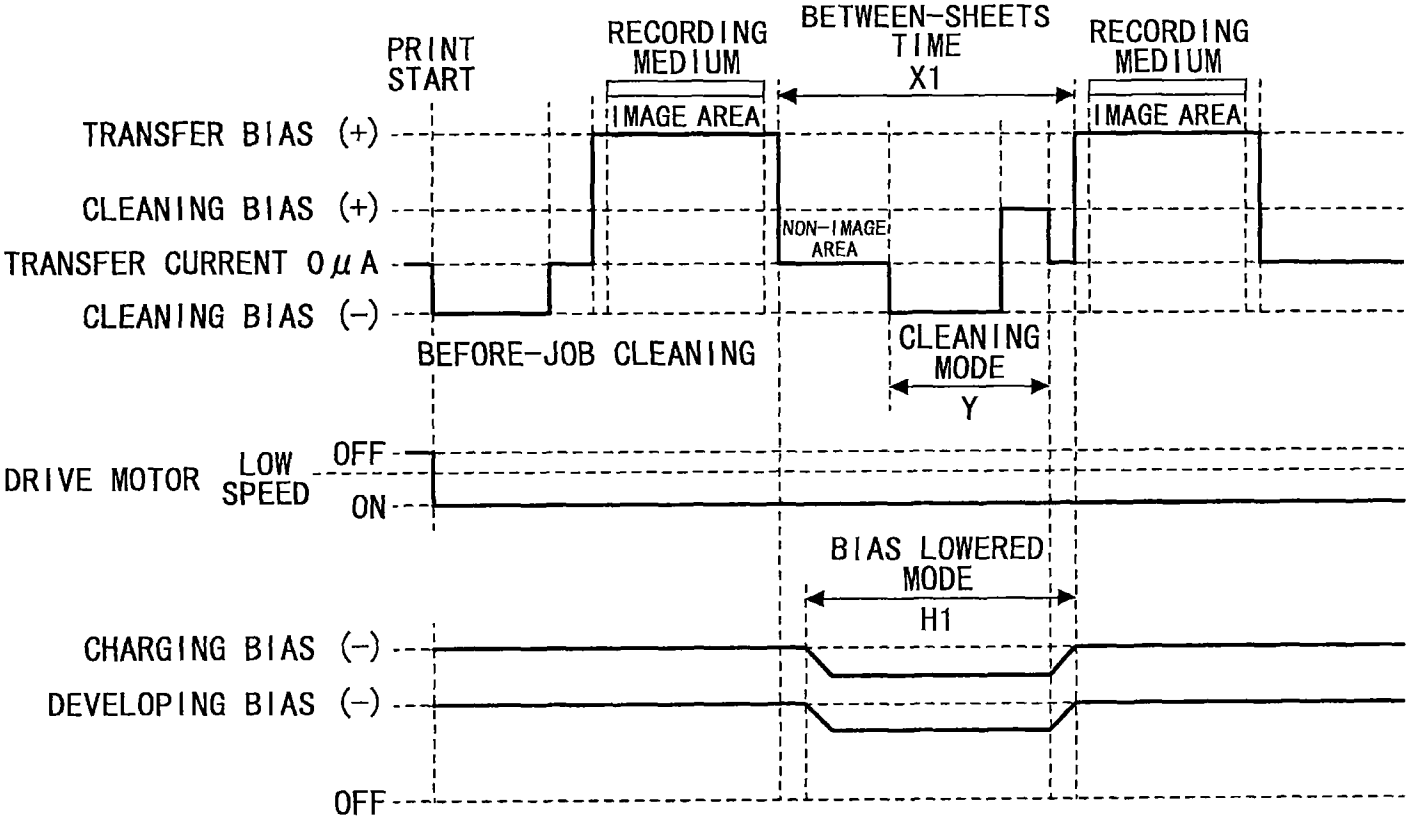
FIGS. 18A-18B are timing charts illustrating control of a power supply unit for a transfer roller and a drive motor as a modified example of FIG. 17.
Figure 18B:
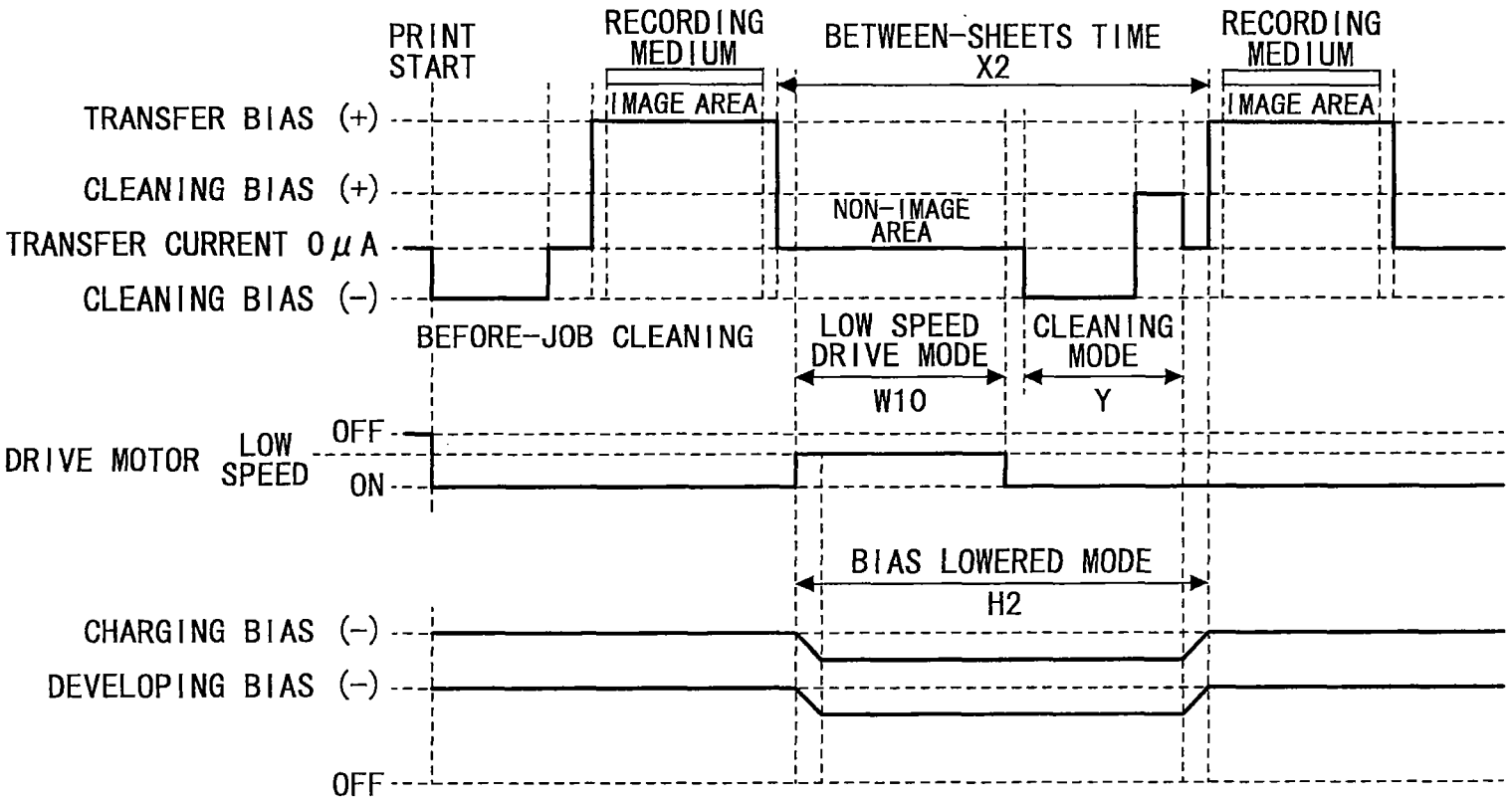

To describe in detail, in the present embodiment 4, similar to the embodiment 1, as shown in FIG. 17A, in the case where the time X (between-sheets time X0) does not exceed the threshold value A (in the case where $X \leq A$), the power supply unit 35 for the transfer roller (bias applying unit) is controlled to apply non-image area bias (0 μA) during all of the time X (between-sheets time X0). Also, the drive motor 15 (drive unit) is controlled in such a way that during all of the time X (between-sheets time X0), the driven member such as the photoconductor drum 5 and the developing device 42 are driven with a speed (rotation speed) of normal time (image forming operation time) (the drive motor 15 is controlled in such a way that it is in an ON state continuously including the between-sheets time).

Figure 17B:
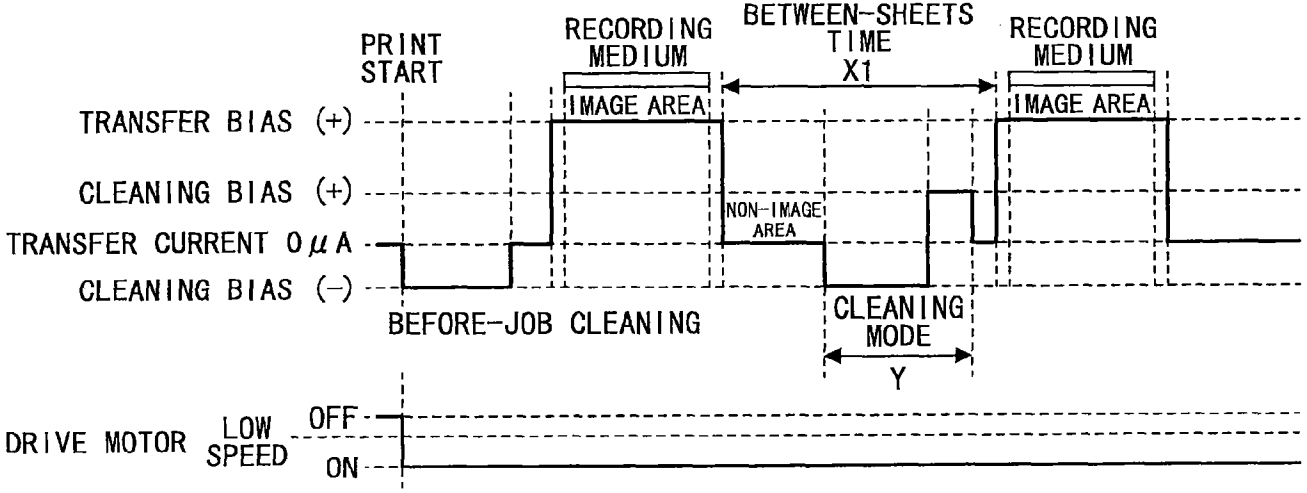

On the other hand, in the present embodiment 4, different from the embodiment 1, as shown in FIG. 17B, in the case where the time X (between-sheets time X1) exceeds the threshold value A and does not exceed the threshold value B ($>A$)($A<X \leq B$), and where the time X (between-sheets time X1) exceeds the threshold value A and does not exceed a threshold value D which is less than the threshold value B ($X \leq D$), the power supply unit 35 for the transfer roller is controlled in such a way that, within the time X (between-sheets time X1), the non-image area bias (0 μA) is applied during the time Z and the cleaning bias is applied during the time (X−Z). Also, the drive motor 15 (drive unit) is controlled in such a way that during all of the time X (between-sheets time X1), the driven member such as the photoconductor drum 5 and the developing device 42 is driven with the speed of normal time (the drive motor 15 is controlled in such a way that it is in an ON state continuously including the between-sheets time).

Figure 17C:
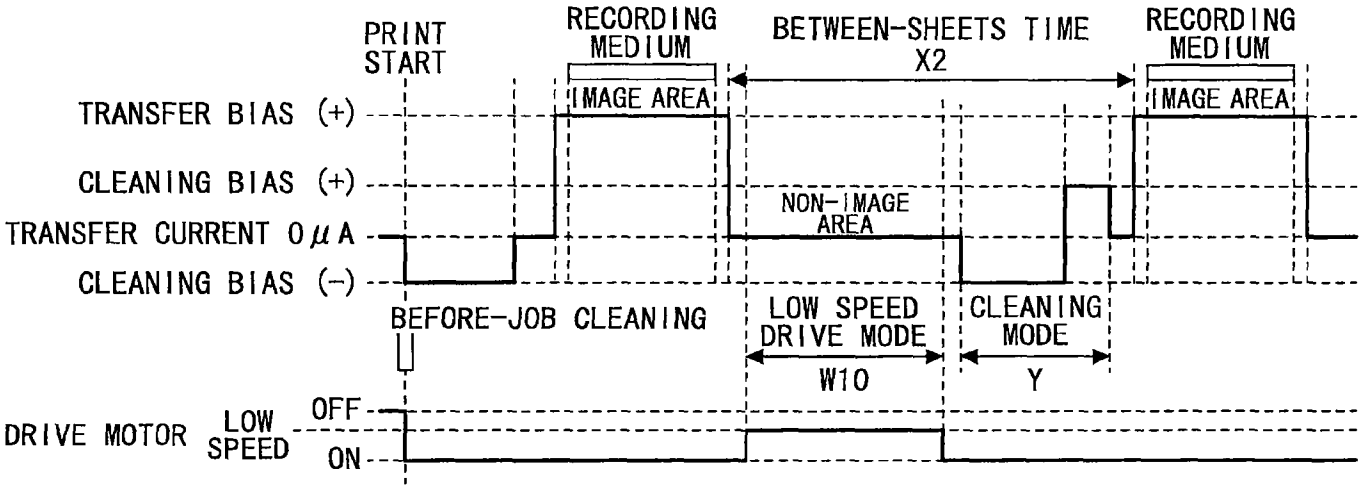

On the other hand, as shown in FIG. 17C, in the case where the time X (between-sheets time X2) exceeds the value X and does not exceed the value B (>A)(A<X≤B), and where the time X (between-sheets time X2) exceeds the above described threshold value D (X<D), the power supply unit 35 for the transfer roller is controlled in such a way that, within the time X (between-sheets time X2), the non-image area bias (0 μA) is applied during the time Z and the cleaning bias is applied during the time (X−Z). Also, the drive motor 15 is controlled in such a way that, within the time X (between-sheets time X2), during the time when the cleaning bias is not applied (time W10), the driven member such as the photoconductor drum 5 and the developing device 42 is driven with a speed (rotation speed) slower than the speed of normal time and during the remaining time (X2−W10), the driven member is driven with the speed of normal time. It should be noted that the control in which the driven member is driven with a speed slower than the speed of normal time is referred to "low speed drive mode" accordingly.

Figure 17D:
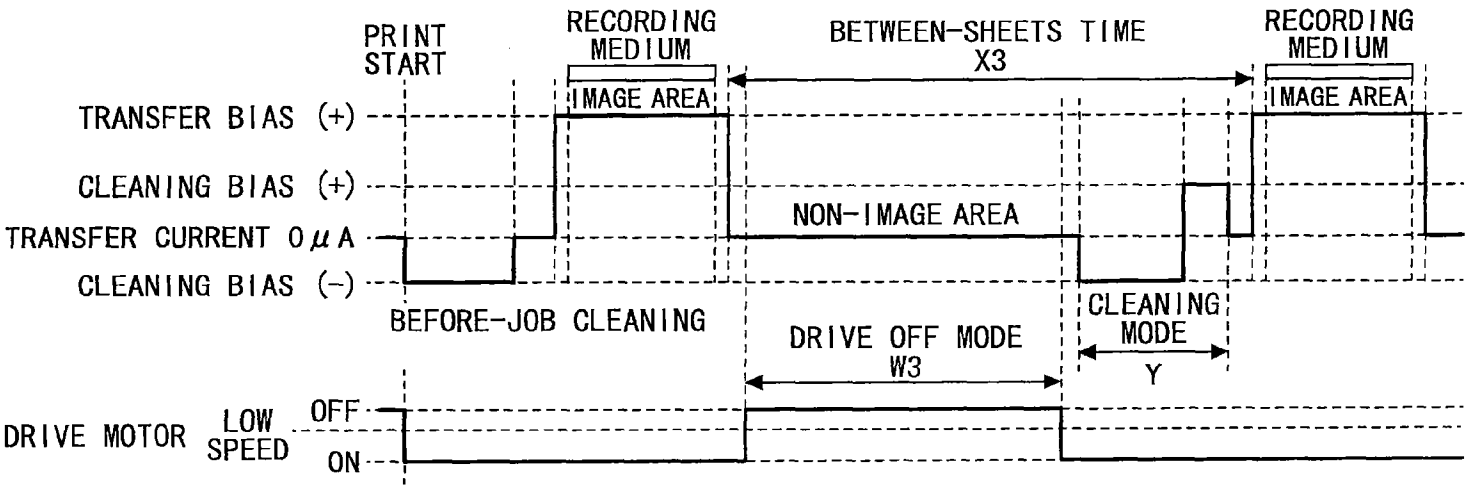

Furthermore, in the present embodiment 4, similar to the embodiment 1, as shown in FIG. 17D, in the case where the time X (between-sheets time X3) exceeds the threshold value B (in the case where X>B), the power supply unit 35 for the transfer roller is controlled in such a way that, within the time X (between-sheets time X3), non-image area bias 0 μA is applied during time Z, which is equivalent to a state in which the bias application is OFF (or, the bias application is OFF so that none of the transfer bias, the cleaning bias, and the non-image area bias is applied) and the cleaning bias is applied during the time (X−Z). Also, the drive motor 15 (drive unit) is controlled in such a way that, within the time X (between-sheets time X3), during the time W, driving the driven member such as the photoconductor drum 5 and the developing device 42 is stopped, and during the time (X−W), driving the driven member such as the photoconductor drum 5 and the developing device 42 with a speed of normal time is performed (the drive motor 15 is controlled in such a way that it is in an OFF state during the time W3 within the between-sheets time and it is in an ON state during the remaining time).

In other words, in the case where the between-sheets time is short, during the between-sheets time, the cleaning mode is not performed and stopping the driving the photoconductor drum 5 and the developing device 42 (drive-OFF mode) is not performed. On the other hand, in the case where the between-sheets time X is of a medium length, during the between-sheets time, the cleaning mode is performed, stopping the driving the photoconductor drum 5 and the developing device 42 (drive OFF mode) is not performed, and the slow speed drive mode is performed or not performed according to the length of the between-sheets time X. Furthermore, in the case where the between-sheets time is long, during the between-sheets time, the cleaning mode is performed and stopping the driving the photoconductor drum 5 and the developing device 42 (drive-OFF mode) is also performed.

It should be noted that in the case where the between-sheets time X is of a medium length, the threshold value D, which is used for determining whether the slow speed drive mode is performed, is defined by taking into account whether a sufficient time can be secured for switching the speed of the drive motor 15 in addition to the cleaning mode performing time within the between-sheets time.

The above control is performed because, as a switching time of the drive motor 15 related to the slow drive mode is short compared to the switching time of the drive motor 15 related to the drive OFF mode, there is a case where a between-sheets time X is short so that the drive OFF mode cannot be performed but the slow speed drive mode can be performed.

Also, by performing the slow speed drive mode as much as possible even in the case where the drive OFF mode cannot be performed, degradation of the driven member and a member abutting the driven member can be alleviated. Specifically, by lowering the drive speed of the developing device 42, the degradation of the developer contained in the developing device 42 or the mechanical wear of the developing roller may be alleviated, and by lowering the drive speed of the photoconductor drum 5, the mechanical wear of the photoconductor drum 5 itself and the cleaning blade may be alleviated and the mechanical wear of the drive motor 15 may be alleviated.

Here, as shown in FIGS. 18A and 18B, in the present embodiment 4, in the case where the time X (between-sheets times X1, X2) exceeds the threshold value A and does not exceed the threshold value B, the absolute value of the developing bias applied to the developing roller (developer bearer) of the developing device 42 and the absolute value of the charging bias applied to the charging device 41 (charging roller) may be controlled to be less than those during the normal time (during the image forming operation), respectively. Specifically, in examples shown in FIGS. 18A-18B, during times H1 and H2 which substantially match the between-sheets times X1 and X3, the "bias lowered mode" is performed in which the absolute value of the developing bias and the absolute value of the charging bias are small.

By performing the control described above, when the bias lowered mode is performed, compared to when the developing bias and the charging bias of a normal strength are applied, the damage to the photoconductor drum 5 caused by application of the biases can be alleviated, thus, the service life of photoconductor drum 5 may be further extended.

It should be noted that in the case where the time X (between-sheets time) does not exceed the threshold value A, the bias lowered mode is not performed because the sufficient time for performing the bias lowered mode cannot be secured and the above benefit is small if the bias lowered mode is performed only for a short time. Also, in the case where the time X (between-sheets time) exceeds the threshold value B, the bias lowered mode is not performed because the application of the developing bias and the charging bias becomes OFF in conjunction with the drive OFF mode.

It should be noted that it is preferable to control a difference between the developing bias and the charging bias (background potential) of the normal time to be the same as a difference in the bias lowered mode time. With the above control, even in the case where the bias lowered mode is performed, a failure can be alleviated in which the background dirt is produced on the photoconductor drum 5 and the carrier adherence is produced on the photoconductor drum 5.

Also, in examples of FIGS. 18A-18B, it is preferable that the charging bias during the bias lowered mode is controlled to be a discharging starting voltage with which a charging potential is started to be formed on the surface of the photoconductor drum 5. With the above control, while hazard for the photoconductor drum 5 is reduced and the service life of the drum is improved, a failure can be prevented in which the charging bias is too small, the charging potential of the photoconductor drum 5 becomes zero, and the background potential cannot be maintained.

As described above, in the present embodiment 4, similar to the above embodiments, in the case where the between-sheets time X in the continuous sheet passing is a short period of time, the "cleaning mode" in which the cleaning bias is applied to the transfer roller 7 is not performed during the between-sheets time X and "drive OFF mode" in which the driving of the driven member such as photoconductor drum 5 and the developing device 42 is stopped is not performed during the between-sheets time X. On the other hand, in the case where the between-sheets time X is of a medium length, during the between-sheets time, the "cleaning mode" is performed but the "drive OFF mode" is not performed. Furthermore, in the case where the between-sheets time X is a long period of time, during the between-sheets time X, both the "cleaning mode" and the "drive OFF mode" are performed.

With the operations described above, without accelerating degradation of the photoconductor drum 5 due to the cleaning bias, and without lowering the productivity during the continuous sheet passing due to performing the cleaning mode, a problem is alleviated in which a back surface or an edge surface of a recording medium P conveyed to the transfer nip unit get dirty due to the toner moved from the photoconductor drum 5 and adhering to the transfer roller 7, and even in a case where between-sheets time frequently becomes long, it is possible to make it difficult to happen that the service life of the photoconductor drum 5 and the developing device 42 is shortened.

It should be noted that in the embodiments described above, the present invention is applied to a monochrome image forming apparatus 1 in which one photoconductor drum 5 is arranged as an image formation unit 4, the present invention can also be naturally applied to a color image forming apparatus in which multiple photoconductor drums corresponding to multiple colors of toner are arranged as an image formation unit.

Also, in the embodiments described above, the present invention is applied to an image forming apparatus 1 in which a toner image borne on the photoconductor drum 5 as an image bearer is transferred onto the recording medium P. On the other hand, the present invention can also be naturally applied to an image forming apparatus in which a toner image borne on a photoconductor belt as an image bearer is transferred onto a recording medium, or an image forming apparatus in which a toner image borne on an intermediate transfer body such as an intermediate transfer belt or an intermediate transfer drum as an image bearer is transferred onto a recording medium.

Also, in the embodiments described above, the present invention is applied to an image forming apparatus 1 in which the transfer roller 7 is arranged as a transfer rotation body. On the other hand, the present invention can also be naturally applied to an image forming apparatus in which a transfer belt is arranged as a transfer rotation body, or an image forming apparatus in which a secondary transfer roller is arranged as a transfer rotation body.

Also, in the cases described above, the similar benefit as the above embodiments can be obtained.

Figure 19A:
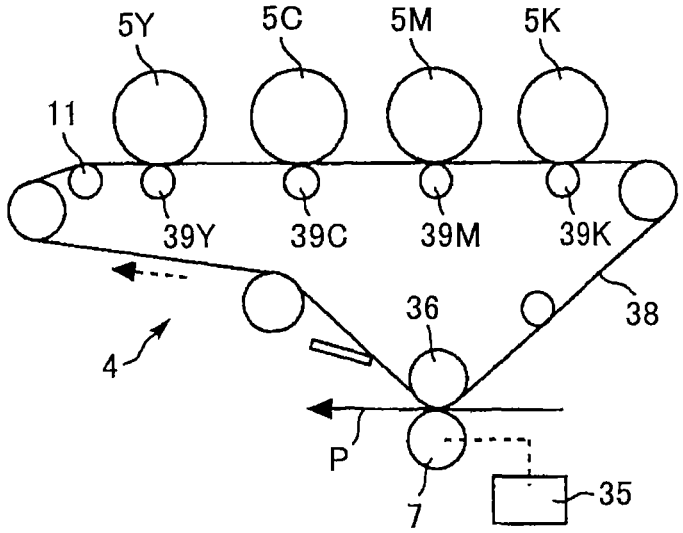
FIGS. 19A-19B are configuration diagrams illustrating main parts of an image forming apparatus according to other embodiments.
Figure 19B:
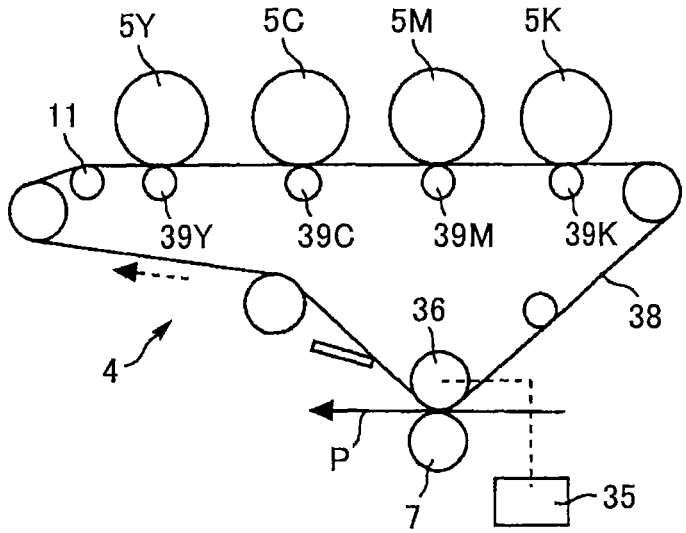

FIGS. 19A-19B are configuration diagrams illustrating main parts in a color image forming apparatus in which multiple photoconductor drums 5Y, 5M, 5C, and 5K corresponding to multiple colors of toner are arranged as an image formation unit 4. FIGS. 19A-19B are modified examples in which an intermediate transfer belt is used as an image bearer, a secondary transfer roller 7 is used as a transfer rotation body, and further, a transfer counter rotating body (secondary transfer counter roller 36) abutting the transfer rotation body (secondary transfer roller 7) via the image bearer (intermediate transfer belt 38) is arranged. It should be noted that in FIGS. 19A-19B, because the image forming apparatus other than the image formation unit 4 can be configured almost the same as the embodiments shown in FIG. 1, figures and descriptions thereof are omitted.

To describe in detail, four primary transfer rollers 39Y, 39M, 39C, and 39K form primary transfer nips, respectively, with the photoconductor drums 5Y, 5M, 5C, and 5K, in which nips the intermediate transfer belt 38 is nipped. Also, a primary transfer voltage (primary transfer bias) whose polarity is opposite to toner is applied to the primary transfer rollers 39Y, 39M, 39C, and 39K.

Also, the intermediate transfer belt 38 moves in a direction of the dashed arrow line and passes through the primary transfer nips of the primary transfer rollers 39Y, 39M, 39C, and 39K in this order. In this way, color toner images formed on the corresponding photoconductor drums 5Y, 5M, 5C, and 5K (images, similar to the above embodiments, respectively formed after going through a charging process, an exposure process, and a developing process) are primarily transferred and superposed onto the intermediate transfer belt 38 repeatedly.

Then, the intermediate transfer belt 38 (image bearer) onto which the superposed color toner images are transferred repeatedly arrives at a position opposed to the secondary transfer roller 7 (transfer rotation body). At this position, the transfer counter roller 36 forms a secondary transfer nip (transfer nip unit) with the secondary transfer roller 7, in which nip the intermediate transfer belt 38 is nipped. Then, the superposed four color toner images formed on the intermediate transfer belt 38 are transferred onto the recording medium P which is conveyed to a position of the secondary transfer nip (transfer nip unit).

Here, in FIG. 19A, similar to the above embodiments, the transfer bias and the cleaning bias are applied from the power supply unit 35 to the secondary transfer roller 7 as a transfer rotation body and the normal transfer process (secondary transfer process) and the cleaning mode are performed.

On the other hand, in FIG. 19B, the transfer bias and the cleaning bias are applied from the power supply unit 35 not to the secondary transfer roller 7 but to the secondary transfer counter roller 36 as a transfer counter rotation body. The applying timing of the transfer bias and the cleaning bias applied to the secondary transfer counter roller 36 is the same as the above embodiments as shown in FIG. 19A, but the polarities of the transfer bias and the cleaning bias are opposite to the above embodiments as shown in FIG. 19A. Specifically, referring to the corresponding example shown in FIG. 7, a transfer bias with a negative polarity is applied to the secondary transfer counter roller 36 to perform the normal transfer process, and during the between-sheets time, after the first cleaning bias with a positive polarity is applied, the second cleaning bias with a negative polarity is applied to perform the cleaning mode.

It should be noted that, although not shown, in the case where the transfer bias, the cleaning bias, and the non-image area bias are applied to each of the secondary transfer roller 7 (transfer rotation body) and the secondary transfer counter roller 36 (transfer counter rotation body) to perform the transfer process and the cleaning mode, the application of the transfer bias, the cleaning bias, and the non-image area bias as shown in FIG. 19A and the application of the transfer bias, the cleaning bias, and the non-image area bias as shown in FIG. 19B are performed at the same timings.

Also, in the cases described above, when the between-sheets time X exceeds the threshold value B, in addition to the above cleaning mode, the drive OFF mode will be performed in which the driving of the driven member such as the intermediate transfer belt 38, multiple photoconductor drums 5Y, 5M, 5C, 5K, and the developing device is stopped.

Also, in the cases described above, a similar benefit as that of the above embodiments can be obtained.

Also, in the above embodiments, it is assumed that the value of the non-image area bias applied to the transfer roller 7 is 0 μA, but the value of the non-image area bias is not limited to this value. A non-image area bias of any value can be applied to the transfer roller 7 as long as the absolute value of which is less than the absolute value of the cleaning value.

To describe in detail, the power supply unit 35 for the transfer roller (bias applying unit) is controlled in such a way that during the time Z when the cleaning mode is not performed within the between-sheets time, the value of the transfer current flowing in the transfer roller 7 (non-image area bias) is a predetermined value. The predetermined value can be any value as long as the absolute value of which is set less than the absolute value of the cleaning bias. For example, in the case where the cleaning bias includes a first cleaning bias whose polarity is opposite to the transfer bias and a second cleaning bias whose polarity is the same as the transfer bias, the absolute value of the predetermined value is set less than the absolute value of any of the first cleaning bias and the second cleaning bias. On the other hand, in the case where the cleaning bias includes only a reverse bias whose polarity is opposite to the transfer bias, the absolute value of the predetermined value is set less than the absolute value of the reverse bias. However, it is preferable to set the transfer current (non-image area bias) small enough to the extent that not only the normally charged toner but also the reverse charged toner are not attracted to the transfer roller 7 too much.

Also, in the above embodiments, the power supply unit 35 for the transfer roller (bias applying unit) is under constant current control, but the power supply unit 35 for the transfer roller (bias applying unit) may be under constant voltage control.

Also, in the cases described above, the similar benefit as the above embodiments can be obtained.

Also, in the above embodiments, in the case where the between-sheets time X exceeds the threshold value B, the photoconductor drum 5 and the developing device 42 are used as a driven member for which the "drive OFF mode" is performed. The driven member for which the drive OFF mode is performed is not limited to the photoconductor drum 5 and the developing device 42, but, for example, the fixing device 20, the exposure unit 3 (polygon mirror), and the like may also be used as a driven member for which the drive OFF mode is performed.

Also, in the cases described above, the similar benefit as the above embodiments can be obtained by stopping the driving of the driven member accordingly when the between-sheets time is long. However, compared with the photoconductor drum 5 and the developing device 42, the fixing device 20 is not suited as a driven member for which the drive OFF mode is performed because it is necessary to maintain the fixing temperature of the fixing belt 21 (fixing member) of the fixing device 20 at an appropriate temperature without unevenness in the circumferential direction, and the fixing device 20 also has a function for conveying the recording medium P. Also, compared with the photoconductor drum 5 and the developing device 42, the polygon mirror of the exposure unit 3 is not suited as a driven member for which the drive OFF mode is performed because the polygon mirror of the exposure unit 3 requires a high-speed and stable rotational drive with high accuracy.

It should be noted that the present invention is not limited to the above embodiments and the above embodiments may be modified accordingly within the scope of the technical concept of the present invention. Also, the number, position, shape, etc., of the configuration members are not limited to the above embodiments and can be any suitable number, position, shape, etc., in practicing the present invention.

The present application is based on and claims the benefit of priority of Japanese Priority Application No. 2014-160107 filed on Aug. 6, 2014, and Japanese Priority Application No. 2014-232597 filed on Nov. 17, 2014, the entire contents of which are hereby incorporated herein by reference.

What is claimed is:

1. An image forming apparatus, comprising:

an image bearer configured to be driven to run in a first predetermined direction;

a transfer rotation body configured to rotate in a second predetermined direction and abut the image bearer to form a transfer nip unit;

a bias applying unit configured to transfer a toner image onto a recording medium conveyed to the transfer nip unit by applying a transfer bias to the transfer rotation body; and a driven member configured to be driven by a drive unit during an image forming operation, wherein the bias applying unit is configured to apply a cleaning bias for removing toner adhered to the transfer rotation body and apply a non-image area bias whose absolute value is less than the cleaning bias to the transfer rotation body, time X, which is defined as between-sheets time from when the recording medium is fed out at the transfer nip unit to when the next recording medium is fed into the transfer nip unit while the image bearer is in a driven state and a plurality of the recording media are continuously conveyed, varies based on a predetermined condition, in the case where the time X does not exceed a threshold value A, the bias applying unit is controlled to apply the non-image area bias during all of the time X and the drive unit is controlled to drive the driven member during all of the time X, in the case where the time X exceeds the threshold value A and does not exceed a threshold value B which is greater than the threshold value A, the bias applying unit is controlled to apply the non-image area bias during time Z within the time X and apply the cleaning bias during time (X-Z), and the drive unit is controlled to drive the driven member during all of the time X, and in the case where the time X exceeds the threshold value B, the bias applying unit is controlled to, during the time Z within the time X, turn OFF bias application so that none of the transfer bias, the cleaning bias, and the non-image area bias is applied, or to apply the non-image area bias which is equivalent to the bias application being turned OFF, and, during the time (X-Z), apply the cleaning bias, wherein the drive unit is controlled to stop driving the driven member during time W within the time X and drive the driven member during time (X-W).

2. The image forming apparatus according to claim 1, wherein the time Z is controlled to be longer as the time X becomes longer.

3. The image forming apparatus according to claim 2, wherein the time (X-Z) is fixed regardless of the time X's length.

4. The image forming apparatus according to claim 1, wherein the driven member is the image bearer, and in the case where the time X exceeds the threshold value B, the drive unit is controlled to stop driving the image bearer during the time Z within the time X.

5. The image forming apparatus according to claim 4, wherein the driven member is a developing roller of a developing device and the image bearer, and in the case where the time X exceeds the threshold value B, the drive unit is controlled to drive and stop driving the developing roller of the developing device at almost the same timing as the drive unit drives and stops driving the image bearer during the time X.

6. The image forming apparatus according to claim 1, wherein the driven member is a developing roller of a developing device, and in the case where the time X exceeds the threshold value B, the drive unit is controlled to stop driving the developing roller of the developing device during the time X.

7. The image forming apparatus according to claim 1, wherein the drive unit is configured to drive the driven member in a reverse direction with respect to a drive direction during the image forming operation, in the case where the time X exceeds the threshold value B, the drive unit is controlled to drive the driven member in the reverse direction right before the drive unit stops driving the driven member during the time W.

8. The image forming apparatus according to claim 1, wherein in the case where the time X exceeds a threshold value C which is greater than the threshold value B, an adjustment operation related to an image forming operation is performed at a timing during time (X-W) before the bias applying unit is controlled to apply the cleaning bias.

9. The image forming apparatus according to claim 1, wherein the bias applying unit is controlled to, when applying the cleaning bias during the between-sheets time, not start applying the cleaning bias right after the beginning of the between-sheets time and finish applying the cleaning bias right before the end of the between-sheets time.

10. The image forming apparatus according to claim 1, wherein the driven member is the image bearer, and the bias applying unit is controlled to, in the case where the between-sheets time X exceeds the threshold value A and does not exceed the threshold value B, not start applying the cleaning bias right after the beginning of the between-sheets time and finish applying the cleaning bias right before the end of the between-sheets time, and in the case where the time X exceeds the threshold value B, start and finish applying the cleaning bias before the drive unit stops driving the image bearer.

11. The image forming apparatus according to claim 1, wherein the bias applying unit is controlled to, when applying the non-image area bias, use constant current control so that a value of the non-image area bias is 0 μA.

12. The image forming apparatus according to claim 1, wherein the time (X-Z) is set to a time during which the transfer rotation body rotates at least one or more times.

13. The image forming apparatus according to claim 1, wherein the cleaning bias includes a first cleaning bias whose polarity is opposite to the transfer bias and a second cleaning bias whose polarity is the same as the transfer bias and which is applied following the first cleaning bias.

14. The image forming apparatus according to claim 1, wherein an absolute value of the cleaning bias is less than an absolute value of the transfer bias.

15. The image forming apparatus according to claim 1, wherein the predetermined condition includes at least one of an operation condition of a post-processing device which provides a post-process to the recording medium for which image forming has been performed by an image forming apparatus body, a temperature condition of a non-paper passing area on a fixing device which fixes a toner image on the recording medium transferred at the transfer nip unit, and another temperature condition near the image bearer.

16. The image forming apparatus according to claim 1, wherein a conveyance speed of the recording medium conveyed to the transfer nip unit is controlled to vary, and the bias applying unit is controlled to adjust the cleaning bias based on the conveyance speed.

17. The image forming apparatus according to claim 1, further comprising:

an environment detection unit configured to detect temperature and humidity, wherein the bias applying unit is controlled to adjust the cleaning bias based on a detection result of the environment detection unit.

18. The image forming apparatus according to claim 1, wherein in the case where the time X exceeds the threshold value B, when, right before the time X ends, the driving of the driven member is restarted from a driving stopped state by the drive unit, a timing of the restart is determined by calculating back from a timing of the end of the time X and subtracting time required for turning ON the drive unit and a predetermined margin.

19. The image forming apparatus according to claim 1, wherein in the case where the time X exceeds the threshold value A, does not exceed the threshold value B, and does not exceed a threshold value D which is greater than the threshold value A and less than the threshold value B, the bias applying unit is controlled to apply the non-image area bias during time Z within the time X and apply the cleaning bias during time (X-Z), and the drive unit is controlled to drive the driven member with a first speed during all of the time X, and in the case where the time X exceeds the threshold value A, does not exceeds the threshold value B, and exceeds the threshold value D, the bias applying unit is controlled to apply the non-image area bias during time Z within the time X and apply the cleaning bias during time (X-Z), and the drive unit is controlled to drive the driven member with a speed slower than the first speed while the cleaning bias is not applied during the time X, and to drive the driven member with the first speed during the remaining time.

20. The image forming apparatus according to claim 1, wherein in the case where the time X exceeds the threshold value A and does not exceed the threshold value B, an absolute value of a developing bias applied to a developer bearer of the developing device and an absolute value of a charging bias applied to a charging device are controlled to be less than predetermined values, respectively.

21. The image forming apparatus according to claim 1, wherein the image bearer is a photoconductor drum or a photoconductor belt, and the transfer rotation body is a transfer roller.

22. An image forming apparatus, comprising:

an image bearer configured to be driven to run in a first predetermined direction;

a transfer rotation body configured to rotate in a second predetermined direction and abut the image bearer to form a transfer nip unit;

a transfer counter rotation body abutting the transfer rotation body via the image bearer;

a bias applying unit configured to transfer a toner image onto a recording medium conveyed to the transfer nip unit by applying a transfer bias to the transfer counter rotation body; and a driven member configured to be driven by a drive unit during an image forming operation, wherein the bias applying unit is configured to apply a cleaning bias for removing toner adhered to the transfer rotation body and apply a non-image area bias whose absolute value is less than the cleaning bias to the transfer counter rotation body, time X, which is defined as between-sheets time from when the recording medium is fed out at the transfer nip unit to when the next recording medium is fed into the transfer nip unit while the image bearer is in a driven state and a plurality of the recording media are continuously conveyed, varies based on a predetermined condition, in the case where the time X does not exceed a threshold value A, the bias applying unit is controlled to apply the non-image area bias during all of the time X and the drive unit is controlled to drive the driven member during all of the time X, in the case where the time X exceeds the threshold value A and does not exceed a threshold value B which is greater than the threshold value A, the bias applying unit is controlled to apply the non-image area bias during time Z within the time X and apply the cleaning bias during time (X-Z), and the drive unit is controlled to drive the driven member during all of the time X, and in the case where the time X exceeds the threshold value B, the bias applying unit is controlled to, during the time Z within the time X, turn OFF bias application so that none of the transfer bias, the cleaning bias, and the non-image area bias is applied, or to apply the non-image area bias which is equivalent to the bias application being turned OFF, and, during the time (X-Z), apply the cleaning bias, wherein the drive unit is controlled to stop driving the driven member during time W within the time X and drive the driven member during time (X-W).

* * * * *